US011414606B1

(12) United States Patent
Trygstad et al.

(10) Patent No.: US 11,414,606 B1
(45) Date of Patent: Aug. 16, 2022

(54) SYSTEM AND METHOD FOR PRODUCING HYDROTHERMAL RENEWABLE DIESEL AND SATURATED FATTY ACIDS

(71) Applicant: Aduro Energy, Inc., Ontario (CA)

(72) Inventors: W. Marcus Trygstad, Spring, TX (US); Anil K. Jhawar, London (CA); Muhammad B. I. Chowdhury, London (CA); Shaun J. Fraser, London (CA)

(73) Assignee: Aduro Energy, Inc., Ontario (CA)

( * ) Notice: Subject to any disclaimer, the term of this patent is extended or adjusted under 35 U.S.C. 154(b) by 161 days.

(21) Appl. No.: 16/676,636

(22) Filed: Nov. 7, 2019

Related U.S. Application Data

(60) Provisional application No. 62/757,520, filed on Nov. 8, 2018.

(51) Int. Cl.

| | |
|---|---|
| ***C10G 9/36*** | (2006.01) |
| ***C10G 69/06*** | (2006.01) |
| ***C10G 3/00*** | (2006.01) |

(52) U.S. Cl.
CPC ..... *C10G 9/36* (2013.01); *C10G 3/44* (2013.01); *C10G 3/50* (2013.01); *C10G 3/55* (2013.01);
(Continued)

(58) Field of Classification Search
CPC ... C10G 9/36; C10G 3/55; C10G 3/50; C10G 69/06; C10G 2400/20; C10G 2300/1014;
(Continued)

(56) References Cited

U.S. PATENT DOCUMENTS

| | | | |
|---|---|---|---|
| 1,956,567 | A | 5/1934 | Carleton |
| 3,607,130 | A | 9/1971 | Worley |

(Continued)

FOREIGN PATENT DOCUMENTS

| | | | |
|---|---|---|---|
| CA | 2774062 | A1 | 4/2011 |
| WO | WO2009085461 | A1 | 7/2009 |

(Continued)

OTHER PUBLICATIONS

Md. Zakir Hossain, Anil Kumar Jhawar, Muhammad B.I. Chowdhury, William Z. Xu, Paul A. Charpentier; Deactivation and regeneration studies of activated carbon during continuous decarboxylation of oleic acid in subcritical water; Fuel, vol. 231, Nov. 1, 2018, pp. 253-263.

(Continued)

*Primary Examiner* — Randy Boyer
*Assistant Examiner* — Juan C Valencia
(74) *Attorney, Agent, or Firm* — Davis, Malm & D'Agostine, P.C.; Richard L. Sampson

(57) ABSTRACT

The chemical conversion of renewable oil to obtain a hydrocarbon product suitable as a fuel, includes (i) renewable oil including corn distillers oil (CDO), fatty acid glyceryl esters (FAGE), triacylglycerols (TAG), lipids, and free fatty acids (FFA), which are derived from non-fossil-fuel sources that include animals, plants, vegetables, fruits, grains, algae, and plankton (collectively "oil"); (ii) the chemical transformation of the oil by substantially reducing or eliminating the carboxylate functionality and native unsaturations of fatty acids contained therein; (iii) wherein the hydrocarbon product is substantially a mixture of saturated hydrocarbons, or alkanes, originating from corresponding structures in the oil, e.g., the hydrocarbon chains of fatty acids; and (iv) the product mixture is suitable as fuel (Continued)

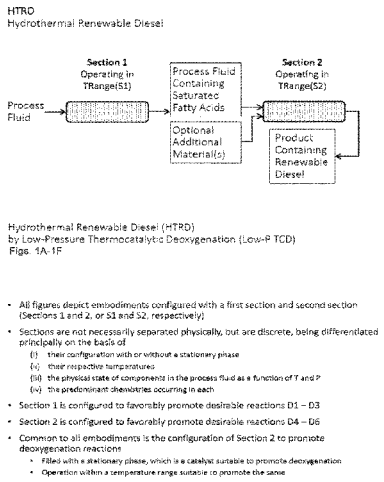

that may be blended with or be used in place of fuel such as diesel derived from petroleum.

40 Claims, 12 Drawing Sheets

(52) U.S. Cl.
CPC ..... *C10G 69/06* (2013.01); *C10G 2300/1014* (2013.01); *C10G 2300/1018* (2013.01); *C10G 2300/4006* (2013.01); *C10G 2300/4012* (2013.01); *C10G 2400/20* (2013.01); *C10G 2400/22* (2013.01)

(58) Field of Classification Search
CPC ..... C10G 2300/4006; C10G 2400/22; C10G 2300/4012; C10G 2300/1018; C10G 3/44
See application file for complete search history.

(56) References Cited

U.S. PATENT DOCUMENTS

| | | | |
|---|---|---|---|
| 4,265,731 | A | 5/1981 | Mitchell |
| 4,719,002 | A | 1/1988 | Mayer et al. |
| 4,778,586 | A | 10/1988 | Bain et al. |
| 4,840,725 | A | 6/1989 | Paspek |
| 6,048,448 | A | 4/2000 | Nirell |
| 6,230,814 | B1 | 5/2001 | Nasr et al. |
| 7,718,051 | B2 | 5/2010 | Ginosar et al. |
| 7,754,931 | B2 | 7/2010 | Monnier et al. |
| 7,816,570 | B2 | 10/2010 | Roberts, IV et al. |
| 7,947,165 | B2 | 5/2011 | Berkowitz et al. |
| 8,105,480 | B2 | 1/2012 | Chornet et al. |
| 8,142,527 | B2 | 3/2012 | Herskowitz et al. |
| 8,975,457 | B2 | 3/2015 | Bressler |
| 9,644,455 | B2 | 5/2017 | Trygstad |
| 9,670,414 | B2 | 6/2017 | Bobe et al. |
| 2005/0150817 | A1 | 7/2005 | Tailman et al. |
| 2008/0099378 | A1 | 5/2008 | He et al. |
| 2008/0274017 | A1* | 11/2008 | Boykin ..... C10G 1/10 422/105 |
| 2009/0090658 | A1 | 4/2009 | Burkus et al. |
| 2009/0159498 | A1 | 6/2009 | Chinn et al. |
| 2010/0236783 | A1 | 9/2010 | Nenniger et al. |
| 2010/0276147 | A9 | 11/2010 | Hocking |
| 2013/0105362 | A1 | 5/2013 | Salazar et al. |

FOREIGN PATENT DOCUMENTS

| | | | |
|---|---|---|---|
| WO | WO2012000115 | A1 | 1/2012 |
| WO | WO2014167424 | A2 | 10/2016 |

OTHER PUBLICATIONS

Md. Zakir Hossain, Muhammad B.I. Chowdhury, Anil Kumar Jhawar, William Z. Xu, Paul A. Charpentier; Continuous low pressure decarboxylation of fatty acids to fuel-range hydrocarbons with in situ hydrogen production; Fuel, vol. 212, Jan. 15, 2018, pp. 470-478.

Md Zakir Hossain, Muhammad B. I. Chowdhury, Anil Kumar Jhawar, William Z. Xu, Mark C. Biesinger, and Paul A. Charpentier; Continuous Hydrothermal Decarboxylation of Fatty Acids and Their Derivatives into Liquid Hydrocarbons Using Mo/Al2O3 Catalyst; ACS Omega 2018 3 (6), 7046-7060.

Lixiong Li, Edward Ooppola, Jeffrey Rine, Jonathan L. Miller, and Devin Walker; Catalytic Hydrothermal Conversion of Triglycerides to Non-ester Biofuels; Energy Fuels 2010, V24, 1305-1315; DOI: 10.1021/ef901163a; Jan. 13, 2010.

Translation of Foreign Office Action cited by Colombian Patent Office in related application Colombian national phase of PCT/US2015/021258, provided by Catillo, Grau & Associates (Bogota, D.C.), in letter to Applicant's attorney dated Aug. 14, 2018.

Supplemental EP Search Report for EP 15765080 dated Oct. 25, 2017; Applicant: Aduro Energy, Inc. et al.; pp. 1-7 references cited herein.

* cited by examiner

Fig. 1
HTRD
Hydrothermal Renewable Diesel

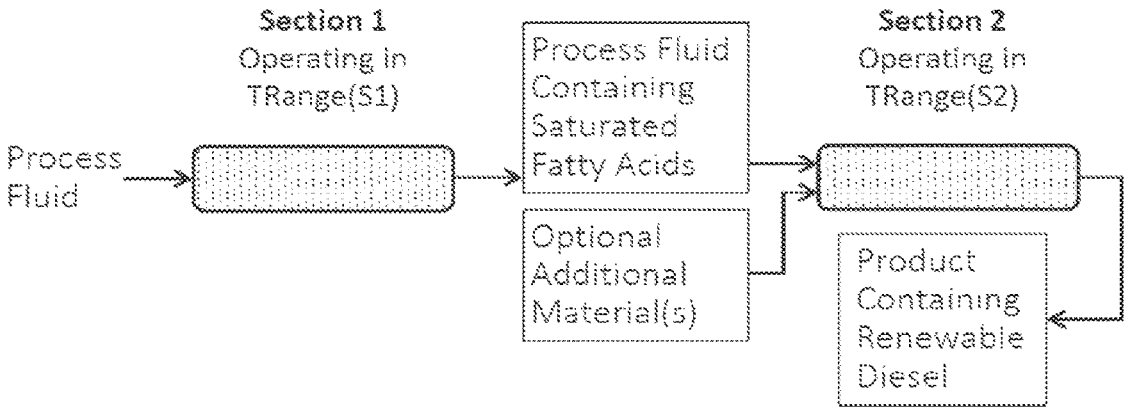

Hydrothermal Renewable Diesel (HTRD)
by Low-Pressure Thermocatalytic Deoxygenation (Low-P TCD)
Figs. 1A-1F

- All figures depict embodiments configured with a first section and second section (Sections 1 and 2, or S1 and S2, respectively)
- Sections are not necessarily separated physically, but are discrete, being differentiated principally on the basis of
  - (i) their configuration with or without a stationary phase
  - (ii) their respective temperatures
  - (iii) the physical state of components in the process fluid as a function of T and P
  - (iv) the predominant chemistries occurring in each
- Section 1 is configured to favorably promote desirable reactions D1 – D3
- Section 2 is configured to favorably promote desirable reactions D4 – D6
- Common to all embodiments is the configuration of Section 2 to promote deoxygenation reactions
  - Filled with a stationary phase, which is a catalyst suitable to promote deoxygenation
  - Operation within a temperature range suitable to promote the same

Fig. 1A

Stationary Phase: a continuous bed comprising a catalyst or two different catalysts in S1 and S2

Temperature: TRange1 in the range TRange(S1) of between about 250 °C to about 360 °C; and TRange2 in the range TRange(S2) of between about Tmax(S1) to about 425 °C Pressure: $P_{OUTLET}$ less than or equal to about 2400 psi; $P_{INLET} \geq P_{OUTLET}$ due to pressure drop across the stationary phase, e.g., less than about $P_{OUTLET}$ + 100 psi Phase: a) water in vapor phase from inlet to outlet; b) optionally, water in liquid phase in an upstream portion after inlet to S1 but vapor in a downstream portion after S1, in accordance with temperature Oil:Water: Between about 1:4 to 4:1

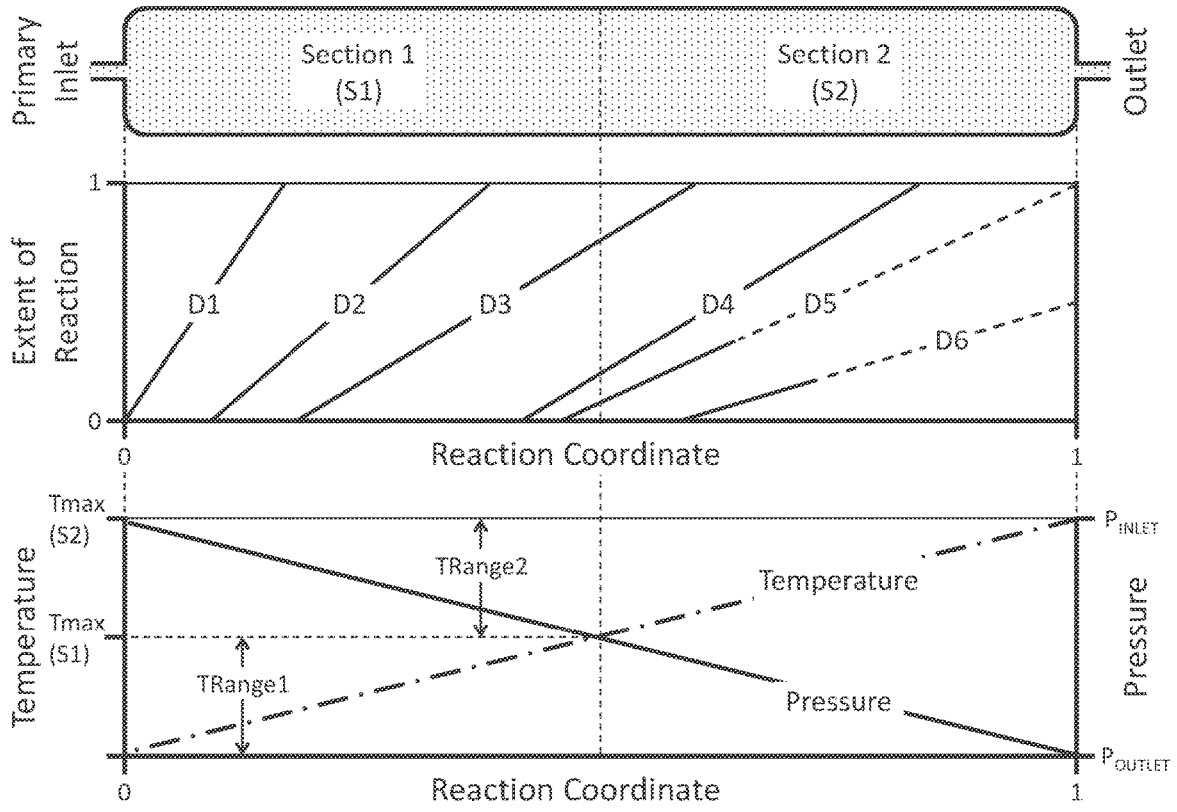

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| | | | | | |
|---|---|---|---|---|---|
| °C | 250 | 275 | 300 | 325 | 350 |
| psi | 577 | 863 | 1247 | 1748 | 2400 |

Fig. 1B

Stationary Phase: a continuous bed comprising a catalyst or two different catalysts in S1 and S2
Temperature: T(S1) in the range TRange(S1) of between about 250 °C to about 360 °C; and T(S2) in the range TRange(S2) of between about Tmax(S1) to about 425 °C
Pressure: $P_{OUTLET}$ less than or equal to about 2400 psi; $P_{INLET} \geq P_{OUTLET}$ due to pressure drop across the stationary phase, e.g., less than about $P_{OUTLET}$ + 100 psi
Phase: a) water in vapor phase from inlet to outlet; b) optionally, water in liquid phase in an upstream portion after inlet to S1 but vapor in a downstream portion after S1, in accordance with temperature
Oil:Water: Between about 1:4 to 4:1

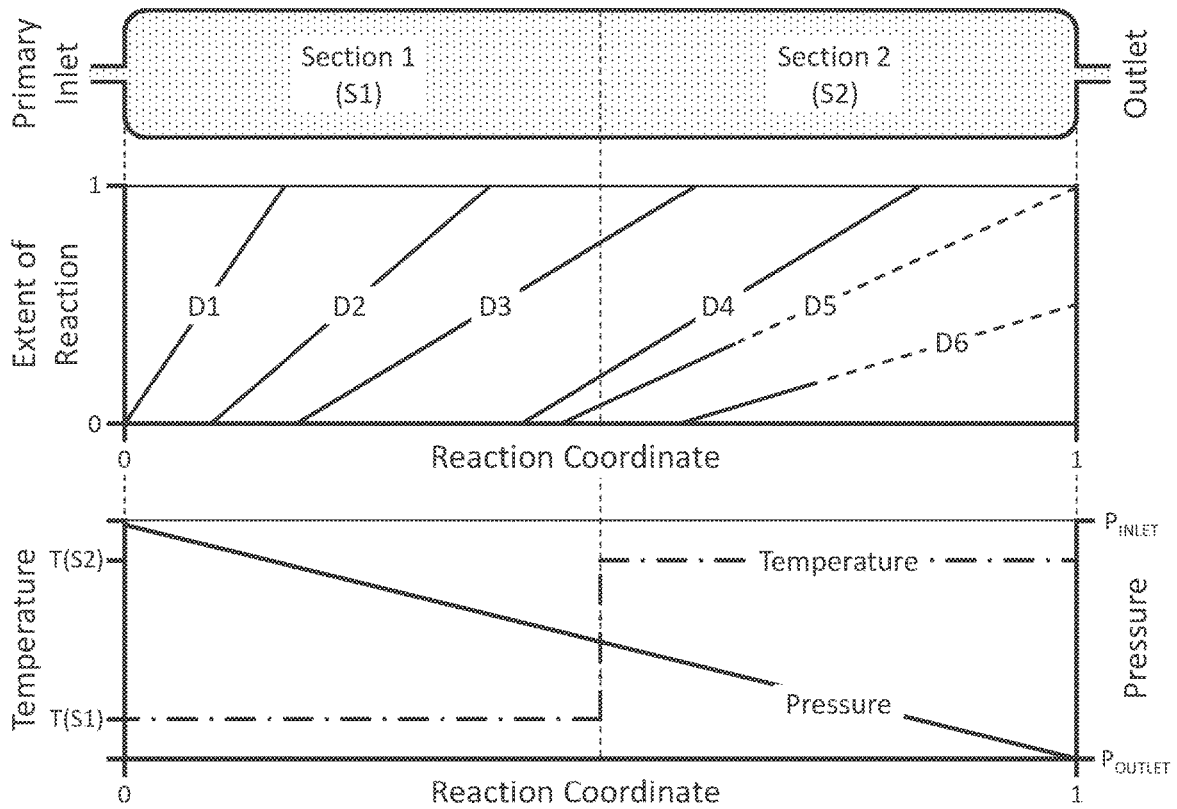

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| °C | 250 | 275 | 300 | 325 | 350 |
|---|---|---|---|---|---|
| psi | 577 | 863 | 1247 | 1748 | 2400 |

Fig. 1C

Stationary Phase: S1 BBs or none; S1.2 and S2 a continuous bed comprising a catalyst or two different catalysts in S1.2 and S2

Temperature: T(S1.1) in the range of between about 250 °C and about 325 °C; TRange2 in the range TRange(S1.2-S2) of between about T(S1.1) to about 425 °C Pressure: In S1.1, sufficient to maintain water in liquid phase; less than about 2400 psi at outlet. Pressure control device at outlet from S1.1 as appropriate (not shown).

Phase: S1.1 water in liquid phase; in S1.2 – S2 a) water is in vapor phase or b) optionally in liquid phase in an upstream portion after S1.1, but in vapor phase by about S2, in accordance with temperature Water:Oil: e.g., 1:4 to 4:1

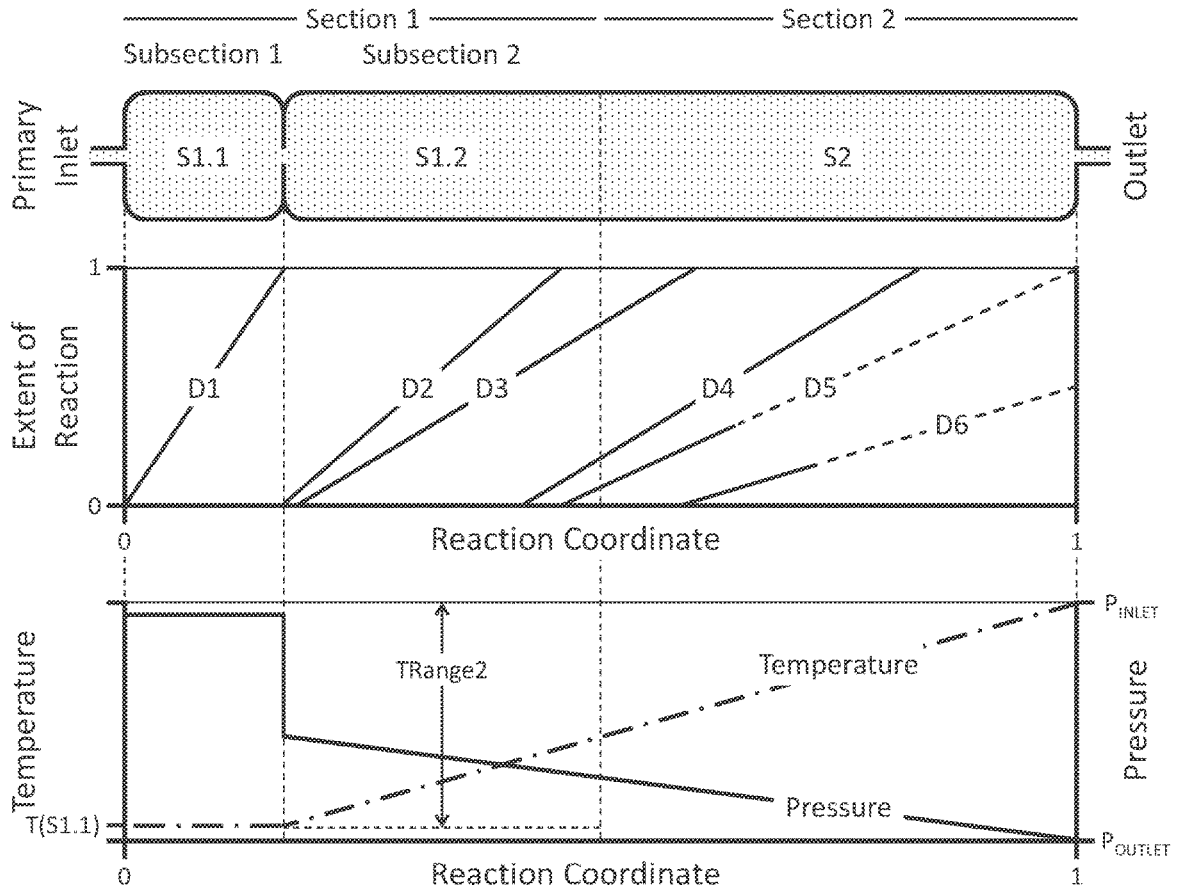

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| °C | 250 | 275 | 300 | 325 | 350 |
|---|---|---|---|---|---|
| psi | 577 | 863 | 1247 | 1748 | 2400 |

Fig. 1D

Stationary Phase: S1 BBs, catalyst, or none; S2 a catalyst same as or different from that in S1

Temperature: T(S1) in the range TRange1 of between about 250 °C and about 360 °C; TRange2 in the range TRange(S2) of between about Tmax(S1) to about 425 °C Pressure: In S1, sufficient to maintain water in liquid phase; in S2 less than about 2710 psi at outlet when Tmax(S2) is about 360 °C such that water is in vapor phase in S2 or optionally is in a liquid phase in an upstream portion of S2 after S1. Pressure control device at outlet from S1 as appropriate (not shown).

Phase: S1.1 water in liquid phase; in S2 a) water in vapor phase or b) optionally in liquid phase in an upstream portion of S2 but in vapor phase in a downstream portion of S2, in accordance with temperature Water:Oil: e.g., 1:4 to 4:1

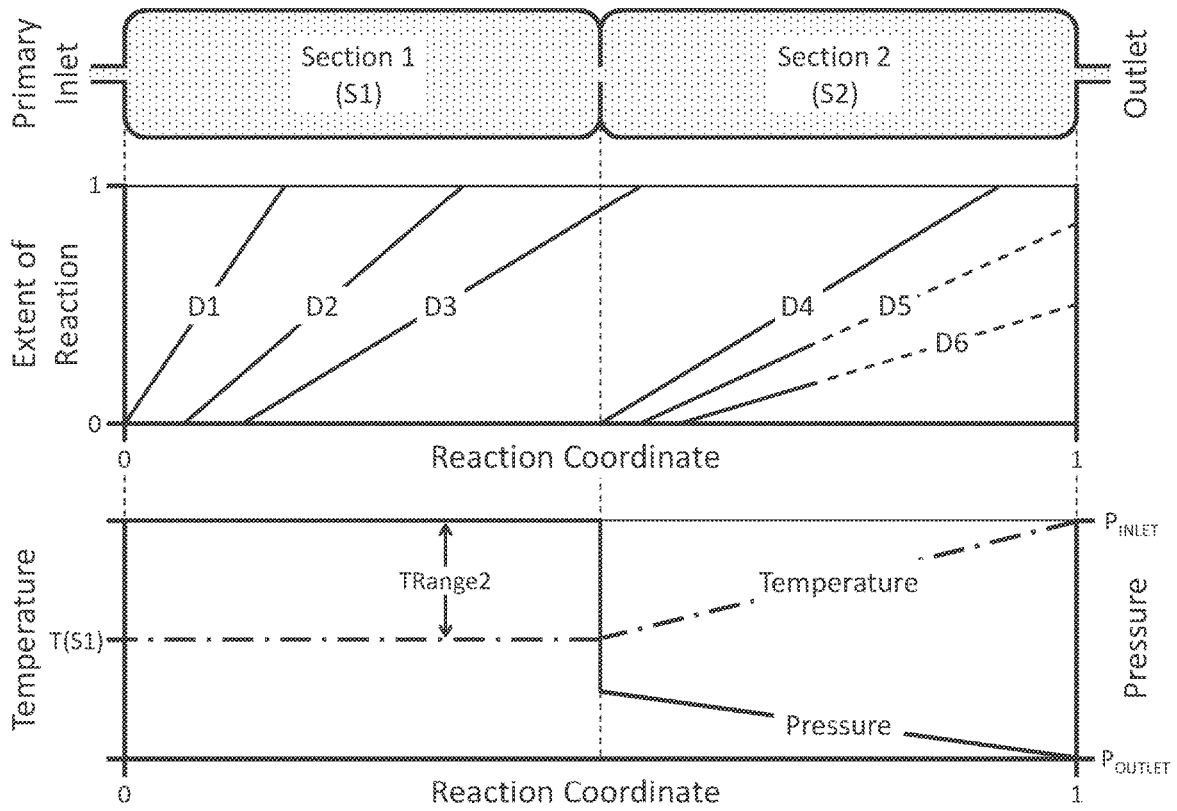

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| °C | 250 | 275 | 300 | 325 | 350 |
|---|---|---|---|---|---|
| psi | 577 | 863 | 1247 | 1748 | 2400 |

Fig. 1E

Stationary Phase: S1.1 BBs or none; S1.2 catalyst; S2 catalyst same as or different from that in S1.2

Temperature: TRange1 in the range TRange(S1) of between about 250 °C and about 360 °C; TRange2 in the range TRange(S2) of between about Tmax(S1) to about 425 °C Pressure: In S1.1 sufficient to maintain water in liquid phase; in S2 less than about 2710 psi at outlet when Tmax(S2) is about 360 °C such that water is in vapor phase in S2 or optionally is in a liquid phase in an upstream portion of S2 after S1

Phase: In S1.1 and S1.2 – S2, water in liquid phase; in S2 a) water in vapor phase or b) optionally in liquid phase in an upstream portion of S2 but in vapor phase in a downstream portion of S2, in accordance with temperature Water:Oil: e.g., 1:4 to 4:1

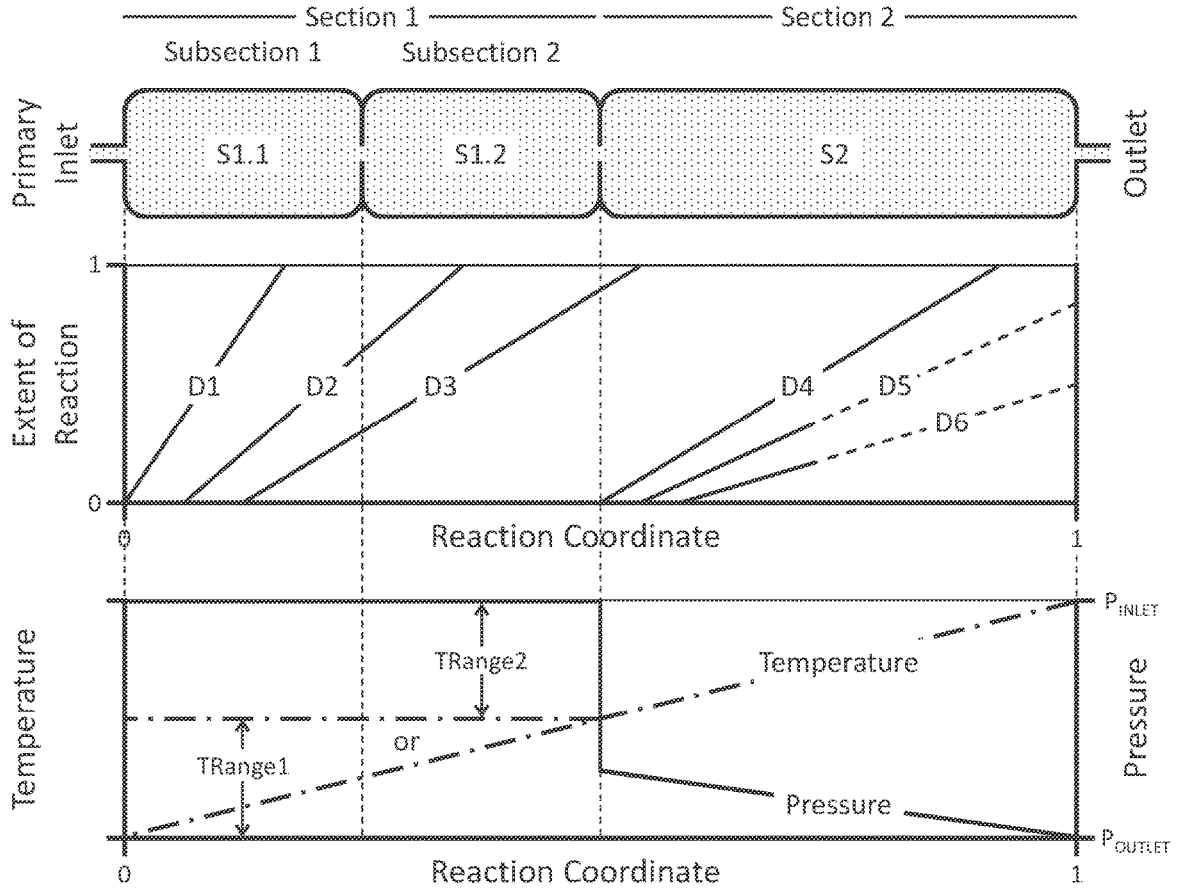

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| °C | 250 | 275 | 300 | 325 | 350 |
|---|---|---|---|---|---|
| psi | 577 | 863 | 1247 | 1748 | 2400 |

Fig. 1F

Stationary Phase: S1 BBs or none; S1.2-S2 a continuous bed comprising a single catalyst or two different catalysts in S1.2 and S2

Temperature: TRange1 in the range TRange(S1) of between about 250 °C and about 300 °C; TRange2 in the range TRange(S2) of between about Tmax(S1) to about 425 °C Pressure: In S1.1, sufficient to maintain water in liquid phase; less than about 2400 psi at outlet Phase: In S1.1 water in liquid phase; in S1.2 – S2 a) water is in vapor phase or b) optionally in liquid phase in an upstream portion after S1.1, but in vapor phase by about S2

Water:Oil: e.g., 1:4 to 4:1

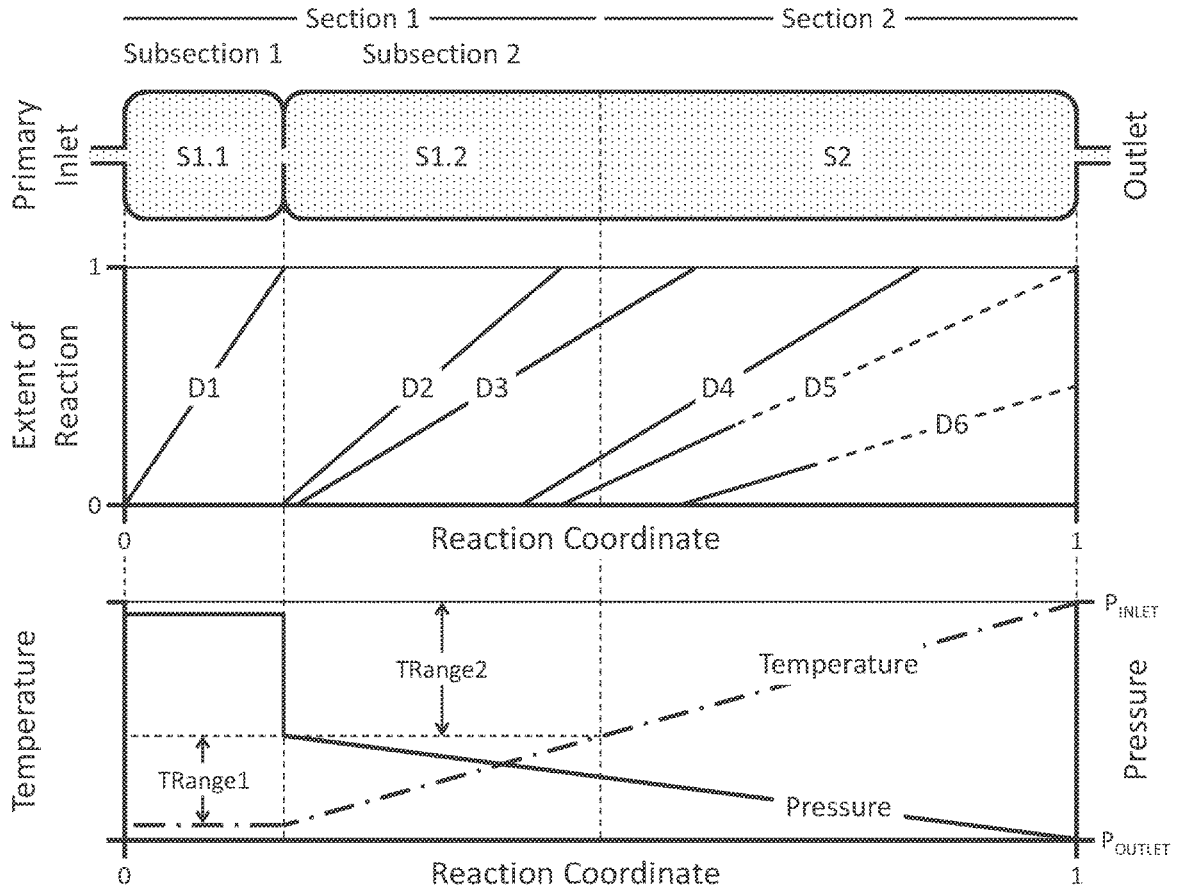

Desirable Reactions

D1 – Hydrolysis of FAGE
D2 – Reforming of Glycerol
D3 – Reduction of native unsaturations in FFA
D4 – Deoxygenation: Decarboxylation and/or Decarbonylation
D5 – Reduction of residual native unsaturations and terminal unsaturations from decarbonylation
D6 – Hydrodeoxygenation Approx. Min P in Upstream Portion of S1 to have liquid water in that Upstream Portion at Tmax(S1)

| °C | 250 | 275 | 300 | 325 | 350 |
|---|---|---|---|---|---|
| psi | 577 | 863 | 1247 | 1748 | 2400 |

Fig. 2
Hydrothermal Production of Saturated Fatty Acids

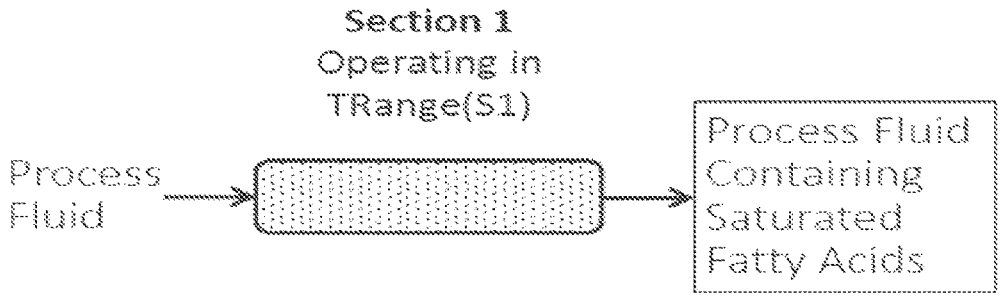

Hydrothermal Production of Saturated Fatty Acids
Figs. 2A-2D

- In contrast to the embodiments for producing HTRD from renewable oil, embodiments for producing saturated fatty acids from oil are configured to promote only the desirable reactions D1 – D3 and not Reactions D4 – D6
  - Temperature ranges in the range of about 250 °C to about 360 °C with preferred temperature ranges in the range of about 320 °C to about 350 °C
- Embodiments such as those portrayed in Figures 9 and 10 contain two subsections
  - S1.1 and S1.2
  - The principal purpose of S1.1 is to quantitatively effect Reaction D1 and also promote D2
  - S1.2 is configured to promote D2 and to maximize saturation yield by D3

Desirable Reactions

D1 – Hydrolysis of FAGE
D2 – Reforming of Glycerol
D3 – Reduction of native unsaturations in FFA

Fig. 2A

Stationary Phase: single fixed bed, BBs or catalyst, e.g. MDA
Temperature: T(S1) in the range TRange(S1) of between about 250 °C and about 360 °C
Pressure: sufficient to maintain water in liquid phase; e.g. less than about 2710 psi when $T_{OUTLET}$ is less than about 360 °C, less than about 2500 psi when $T_{OUTLET}$ is less than about 350 °C, etc. (see table)
Phase: liquid
Water:Oil: e.g., 1:4 to 5:1

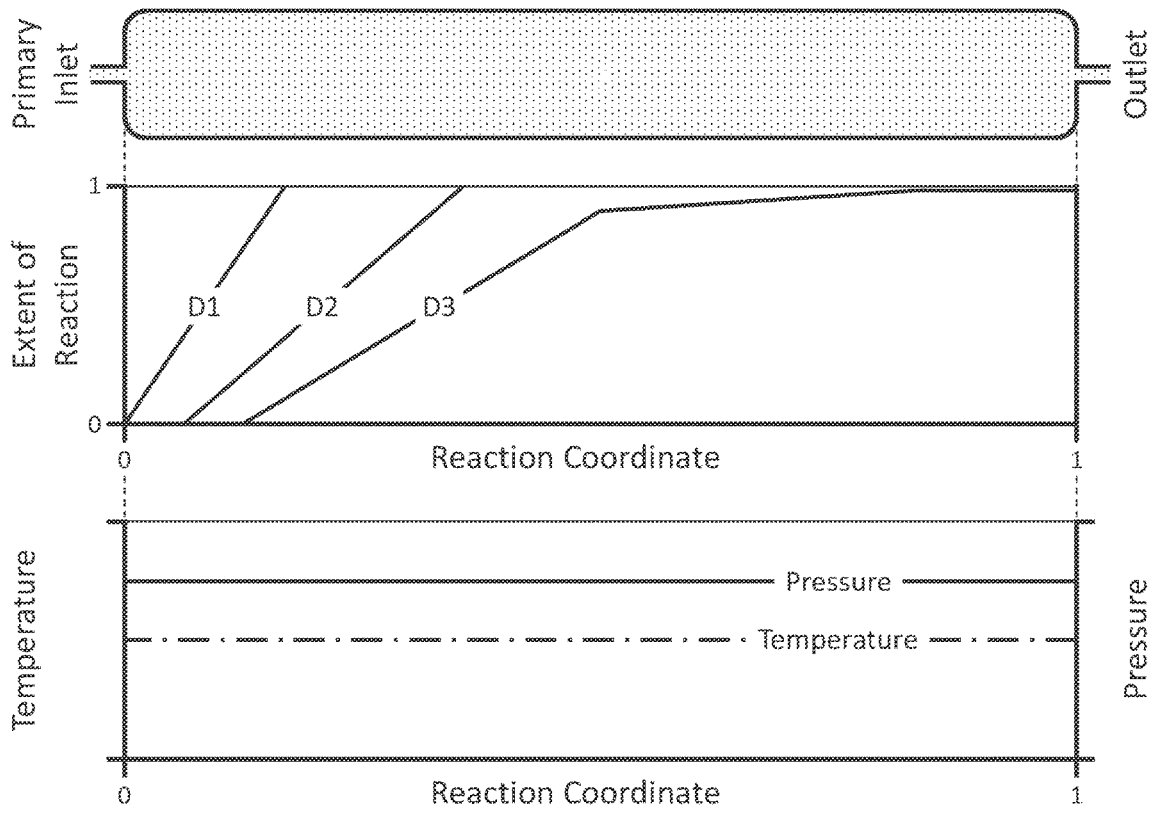

Desirable Reactions

D1 – Hydrolysis of FAGE
D2 – Reforming of Glycerol
D3 – Reduction of native unsaturations in FFA Approx. max P to have water in vapor phase at corresponding temperatures Tmax(S2) at the outlet

| °C | 250 | 275 | 300 | 325 | 350 |
|---|---|---|---|---|---|
| psi | 577 | 863 | 1247 | 1748 | 2400 |

Fig. 2B

Stationary Phase: single fixed bed, BBs or catalyst, e.g. MDA
Temperature: TRange1 in the range TRange(S1) of between about 250 °C and about 360 °C
Pressure: a) low enough to maintain water in vapor phase from inlet to outlet; or optionally b) high enough to maintain water in liquid phase in a portion of the reactor immediately downstream from the inlet, e.g. about 2710 psi when $T_{OUTLET}$ is less than 360 °C, about 2400 psi when $T_{OUTLET}$ is less than 360 °C, etc. (see table)
Phase: a) water entirely in vapor phase; or optionally b) water in liquid phase in an upstream portion of the reactor but vapor in a downstream portion, in accordance with temperature and pressure
Water:Oil: e.g., 1:4 to 5:1

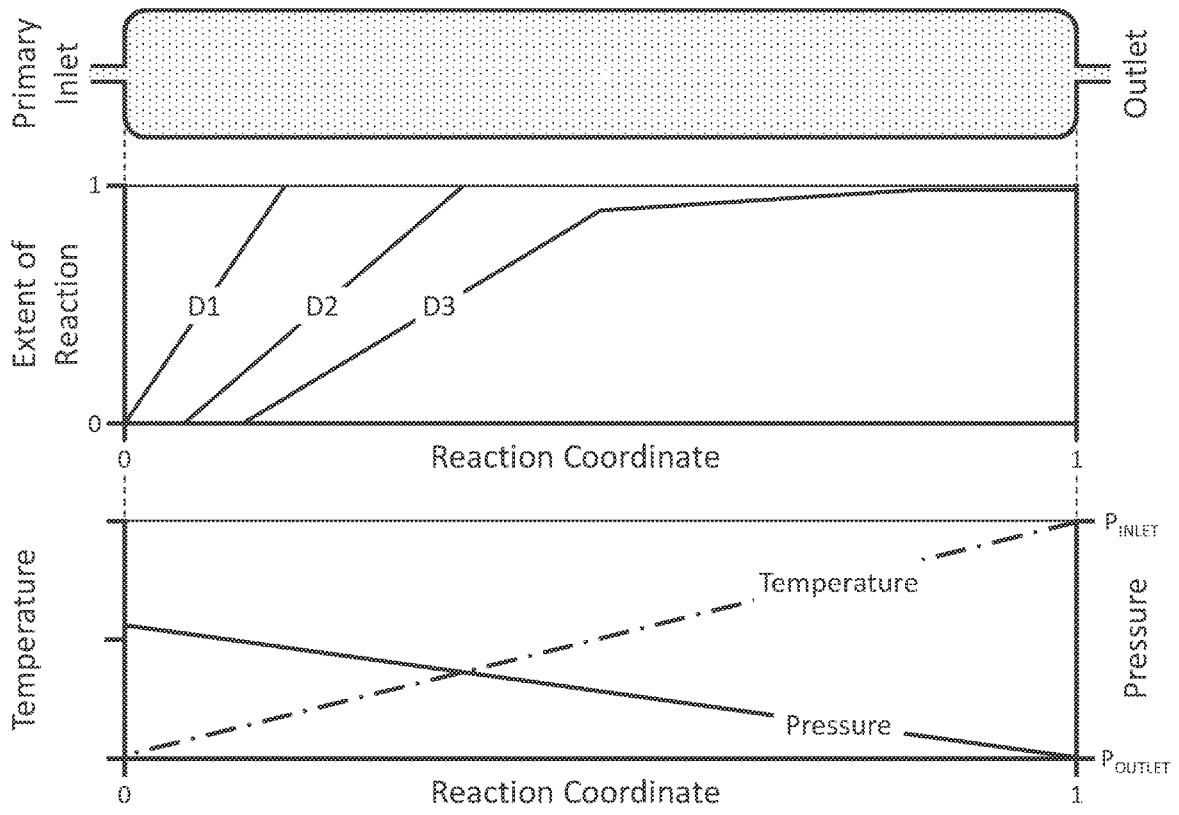

Desirable Reactions

D1 – Hydrolysis of FAGE
D2 – Reforming of Glycerol
D3 – Reduction of native unsaturations in FFA Approx. max P to have water in vapor phase at corresponding temperatures Tmax(S2) at the outlet

| °C | 250 | 275 | 300 | 325 | 350 |
|---|---|---|---|---|---|
| psi | 577 | 863 | 1247 | 1748 | 2400 |

Fig. 2C

Stationary Phase: S1.1 BBs or none; S1.2 catalyst
Temperature: T(S1) in the range TRange(S1) of between about 250 °C and about 360 °C
Pressure: a) high enough to maintain water in liquid phase from inlet to outlet; or b) low enough to maintain water in vapor phase from inlet to outlet
Phase: a) water entirely in liquid phase from inlet to outlet; or optionally b) water in vapor phase from inlet to outlet, in which case P will decline gradually across S1.2
Water:Oil: e.g., 1:4 to 5:1

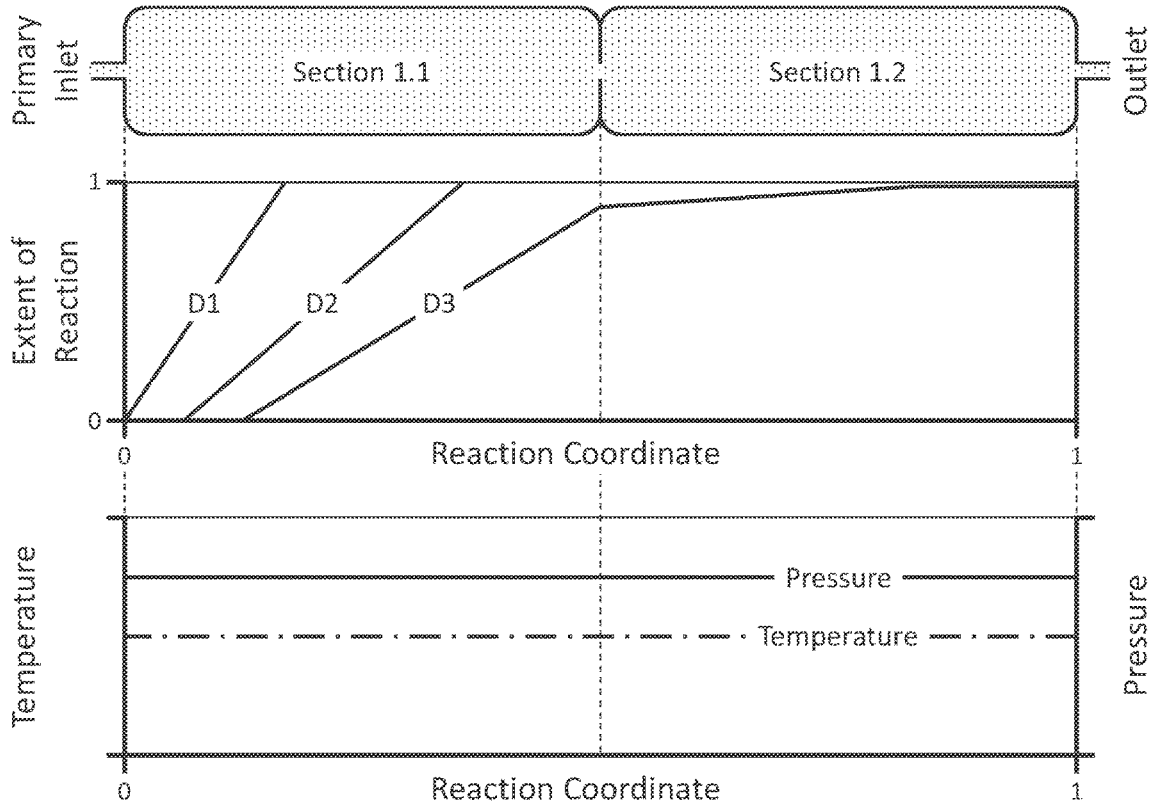

Desirable Reactions

D1 – Hydrolysis of FAGE
D2 – Reforming of Glycerol
D3 – Reduction of native unsaturations in FFA Approx. max P to have water in vapor phase at corresponding temperatures Tmax(S2) at the outlet

| °C | 250 | 275 | 300 | 325 | 350 |
|---|---|---|---|---|---|
| psi | 577 | 863 | 1247 | 1748 | 2400 |

Fig. 2D

Stationary Phase: S1.1 BBs, catalyst, or none; S1.2 catalyst, e.g. MDA
Temperature: T(S1) in the range TRange(S1) of between about 250 °C and about 360 °C
Pressure: a) high enough to maintain water in liquid phase in S1.1, then pressure drop after S1.1 to allow water to vaporize
Phase: a) water entirely in liquid phase in S1.1 and in vapor phase in S1.2
Water:Oil: e.g., 1:4 to 5:1

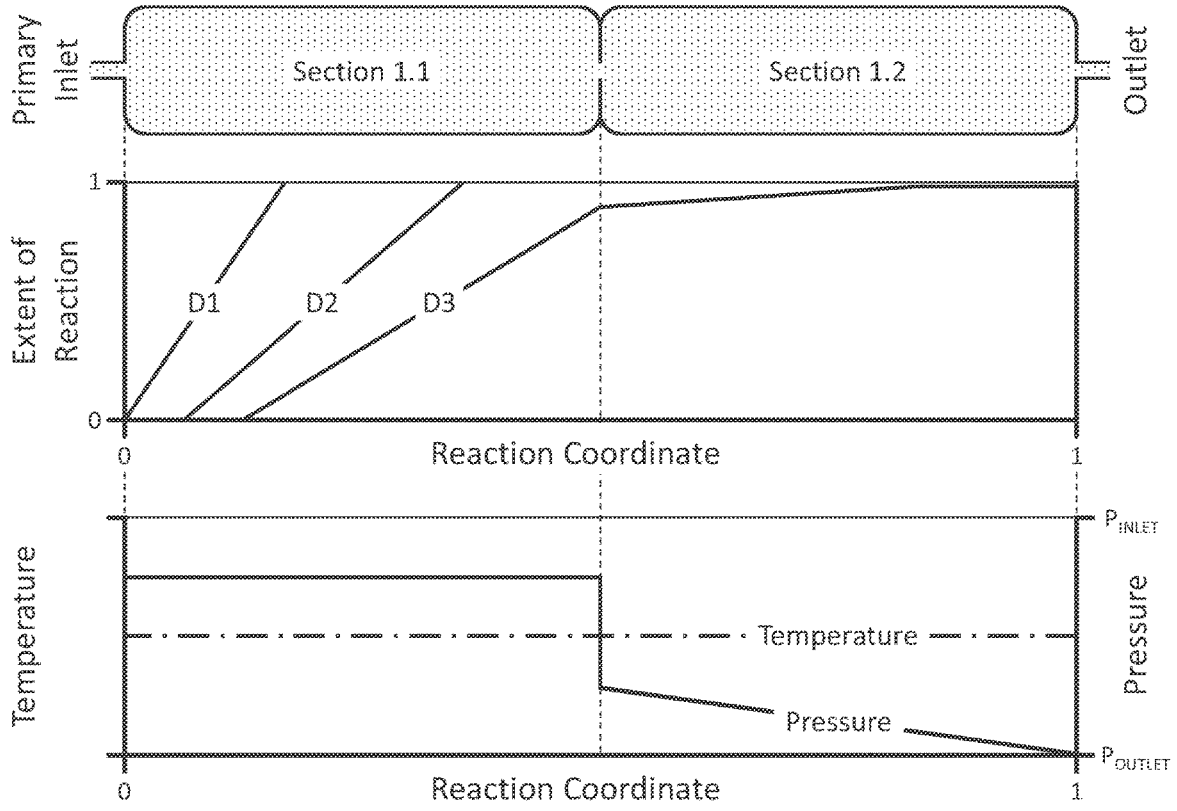

Desirable Reactions

D1 – Hydrolysis of FAGE
D2 – Reforming of Glycerol
D3 – Reduction of native unsaturations in FFA Approx. max P to have water in vapor phase at corresponding temperatures Tmax(S2) at the outlet

| | | | | | |
|---|---|---|---|---|---|
| °C | 250 | 275 | 300 | 325 | 350 |
| psi | 577 | 863 | 1247 | 1748 | 2400 |

SYSTEM AND METHOD FOR PRODUCING HYDROTHERMAL RENEWABLE DIESEL AND SATURATED FATTY ACIDS

RELATED APPLICATION

This application claims the benefit of U.S. Provisional Patent Application Ser. No. 62/757,520, entitled SYSTEM AND METHOD FOR PRODUCING HYDROTHERMAL RENEWABLE DIESEL AND SATURATED FATTY ACIDS, filed on Nov. 8, 2019, the contents of which are incorporated herein by reference in their entirety for all purposes.

BACKGROUND

Technical Field

This invention relates to hydrocarbon processing, and more particularly to systems and methods for efficiently producing renewable diesel and saturated fatty acids.

Background Information

Throughout this application, various publications, patents and published patent applications are referred to by an identifying citation. The disclosures of the publications, patents and published patent applications referenced in this application are hereby incorporated by reference into the present disclosure.

SUMMARY

The instant invention relates to the chemical conversion of renewable oil to obtain a hydrocarbon product suitable as a fuel, where (i) renewable oil includes by way of nonlimiting example corn distillers oil (CDO), fatty acid glyceryl esters (FAGE), triacylglycerols (TAG), lipids, free fatty acids (FFA), and the like, which are derived from non-fossil-fuel sources that include, by way to nonlimiting example, animals, plants, vegetables, fruits, grains, algae, plankton, and the like, and hereinafter shall be referred to inclusively as oil; (ii) the conversion, which is also upgrading, involves chemical transformation of oil by substantially reducing or eliminating both the carboxylate functionality and native unsaturations of fatty acids contained therein; (iii) the hydrocarbon product is substantially a mixture of saturated hydrocarbons, or alkanes, originating from corresponding structures in the oil, e.g., the hydrocarbon chains of fatty acids; and (iv) the product mixture is suitable as fuel that may be blended with or be used in place of fuel such as diesel derived from petroleum.

Embodiments of the instant invention include a system and method for upgrading renewable oil to hydrocarbon fuel by means of a continuous-flow reactor configured to promote a plurality of distinct and desirable chemical reactions substantially sequentially while minimizing certain undesirable chemical reactions. Desirable reactions include hydrolysis of glyceryl esters, saturation of native alkene functionality in fatty acids derived from or contained in the oil, deoxygenation of the fatty acids, saturation of alkene functionality resulting from deoxygenation, and saturation of residual native alkene functionality; undesirable reactions reduce the yield of product obtained through desirable reactions, which is substantially a mixture of alkanes that may be referred to as hydrothermal renewable diesel (HTRD).

BRIEF DESCRIPTION OF THE DRAWINGS

The present invention is illustrated by way of example and not limitation in the figures of the accompanying drawings, in which like references indicate similar elements and in which:

FIG. 1 is a block diagram of one embodiment of the present invention;

FIG. 1A is a graphical representation of aspects of the embodiment of FIG. 1;

FIG. 1B is a graphical representation of aspects of the embodiment of FIG. 1;

FIG. 1C is a graphical representation of aspects of the embodiment of FIG. 1;

FIG. 1D is a graphical representation of aspects of the embodiment of FIG. 1;

FIG. 1E is a graphical representation of aspects of the embodiment of FIG. 1;

FIG. 1F is a graphical representation of aspects of the embodiment of FIG. 1;

FIG. 2 is a is a block diagram of an alternate embodiment of the present invention;

FIG. 2A is a graphical representation of aspects of the embodiment of FIG. 2;

FIG. 2B is a graphical representation of aspects of the embodiment of FIG. 2;

FIG. 2C is a graphical representation of aspects of the embodiment of FIG. 2; and FIG. 2D is a graphical representation of aspects of the embodiment of FIG. 2.

DETAILED DESCRIPTION

Biodiesel. The conversion of lipids from renewable sources into fuel is a subject of global interest that is not merely enduring, but is steadily increasing. It garnered currency long ago due to the ease of transesterifying glyceryl esters of fatty acids from vegetable and animal sources to produce mono-alkyl fatty acid esters that are nominally suitable for blending with diesel from petroleum sources. For example, the base-catalyzed reaction of fatty acid triglycerides with methanol can be carried out at relatively low cost without sophisticated processing equipment to obtain fatty acid methyl esters (FAME) as the transesterification product. Use of other simple alcohols yields corresponding fatty acid alkyl esters whose properties and performance in diesel service may represent improvement over those for FAME, though the benefits may be offset by cost, availability, and material handling considerations. As a group, such fatty acid alkyl esters are referred to as biodiesel, the compound term denoting a special class of fuel that is chemically differentiable from conventional, petroleum-derived diesel by dint of the oxygen-containing ester group. With FAME being arguably the most the common and commercially important type of biodiesel, the terms biodiesel and FAME shall for convenience be used interchangeably hereinafter, and FAME will have the specific meaning of fatty acid methyl ester only when noted as such.

Biodiesel Deficiencies. The facility with which FAME can be produced belies its deficiency as a replacement for, or merely as a supplement to, petroleum-derived diesel. These deficiencies include but are not limited to lower energy content and poor cold property performance compared with conventional diesel produced through petroleum refining. Blended diesel containing 20% FAME, or B20, has an energy value around 117,000 BTU/gallon, which is about 11% lower than the 131,000 BTU/gallon for #2 diesel. The reason is that the "methyl ester" portion of each FAME molecule (the carboxylic acid ester group) contains two atoms of oxygen attached to a single carbon (—COO—), effectively making the latter like a latent $CO_2$ molecule that therefore contributes little energy content upon combustion. Coincidently, that ester —COO— group is 14.8% by weight of methyl oleate, a representative FAME.

The lower energy content of FAME simply means that about 12% more B20 is required to power a vehicle a given distance compared with conventional diesel. But the inferior cold properties may mean that the same vehicle may not be able to go any distance in cold climes. The operational concern is with properties such as cloud point, pour point, and cold filter plug point. As the terms imply, they relate to the way that diesel fuel behaves when put into service in equipment operated at low ambient temperatures. At issue is the fact FAME has a disproportionate, adverse impact cold properties of petroleum diesel into which it is blended. This is due to several of factors, the most important being perhaps that the mono-alkyl ester group in FAME is more polar than the bulk hydrocarbon functionality of conventional diesel. Consequently, FAME is not merely less compatible with, e.g. less soluble in, conventional diesel at lower temperatures, but water has an inherently higher affinity for it compared with compounds in petroleum-derived diesel. Compounding these problems with the use of FAME in cold weather diesel service, most traditional cold flow and anti-gel additives do not improve the flow of B20 very well because they are designed to act upon paraffin wax crystals which exist naturally in petroleum. Those additives are significantly less effective at modifying the cold-temperature behavior of the oxygen-containing ester moiety. Low residual levels of mono-, di- and tri-acyl glycerols not converted to FAME further exacerbate all of these problems.

Environment and Public Policy. The idea of producing fuel such as diesel from non-petroleum sources finds appeal in diverse interests, but perhaps chief among them is the environment. Specifically, because the raw material is the product of carbon capture by photosynthesis in plants or algae, its return into the environment as carbon dioxide after burning in an internal combustion engine qualifies it as carbon-neutral. The second consideration is economics, the conversion of oil into fuel being framed by various factors including the availability and cost of natural oils; the cost to convert them to useable fuels; the availability and cost of petroleum and the means for refining it; politics and public policy; and, as discussed hereinabove, even weather. Examining the drivers behind renewable diesel is beyond the scope of this discussion, but clearly they are strong to the extent that they find sanction in environmental and public policy.

Yet, the question becomes not so much a matter of whether/if but how. That is, how can oil be used to produce fuels from renewable resources while meeting the practical requirement to provide performance comparable to petroleum-derived fuel? The suitability of FAME as a renewable-resource-based diesel blending component may hinge not merely on public policy or concerns about the environment, but on chemical properties that determine its performance "on the street." More elusive still is the vision to convert oil to so-called drop-in diesel, which has all of the attributes of conventional diesel and none of the disadvantages of FAME, permitting it to be directly "dropped into" the normal diesel supply chain.

Renewable Diesel: HDRD. Central to any such quest for diesel equivalency is the elimination of the native carboxylate functionality in oil to yield material comprising only carbon and hydrogen and which is indistinguishable from that obtained from petroleum. As the term biodiesel applies no longer, such material is often referred to alternately as renewable or green diesel to denote that it is "real diesel" derived from replenishable, non-petroleum sources. But the term renewable diesel is ambiguous, as elimination of oxygen from oil or their latent fatty acids may be generally accomplished by different chemical strategies. One depends on the catalytic hydrogenation, also called hydrotreating, which adds molecular hydrogen, $H_2$, under high pressure to both remove oxygen and reduce carbon-carbon double bonds (C═C) native to fatty acids in the oil to produce saturated alkanes in the diesel boiling range. Two principal pathways are available for this oxygen elimination strategy: hydrodeoxygenation (HDO, alternatively referred to as hydrogenolysis); and decarboxylation (DCO). Either way, products from this general approach are referred to as Hydrogenation-Derived Renewable Diesel (HDRD) to denote the central role of molecular hydrogen in their production.

Both HDO and DCO require considerable amounts of molecular hydrogen. Ironically, although the oil used in the production of HDRD is renewable, most often the hydrogen is not. Rather, it is typically produced by steam reforming of fossil fuels such as natural gas or coal with steam at high temperatures. Compounding the irony is the fact that reforming produces a greenhouse gas, carbon dioxide. In time, this twofold incongruity may be rectified through sustainable production of hydrogen without use of fossil fuels, albeit at higher costs: electrolysis of water, where the electricity used for the electrolysis is generated by renewable sources; the use of landfill gas as the feedstock for steam reformation; photocatalytic water splitting using solar energy; and fermentative and enzymatic hydrogen generation from organic materials. Even then, HDRD suffers from other important disadvantages: capex and opex are at high levels corresponding to petrochemical processes; and the possibilities for downward-scalability are limited.

Renewable Diesel: HTRD. The inventors of the instant system and method recognized the need to overcome issues with HDRD, particularly (i) high capex and opex; (ii) the demand to produce large amounts of molecular hydrogen, plus the capex and opex of the associated infrastructure; (iii) the generation of carbon dioxide by steam reformation of fossil fuels to produce that hydrogen; and (iv) scalability limitations. As will be described in greater detail, the instant invention accomplishes all of this through non-obvious means, which includes a novel system and method for producing renewable diesel by processing oil at elevated temperatures with the aid of water but without the addition of molecular hydrogen to saturate C═C native to the fatty acid chains and to remove the carboxyl group from fatty acids, hence the term, hydrothermal renewable diesel (HTRD).

Whether the upgraded oil is HDRD or HTRD, its production by means of a continuous process is a practical and commercial necessity. Thus, although studies conducted in closed, pressurized vessels provide information suggestive of conditions and chemistry for deoxygenating oil, commercial relevance of batch reactors is limited due to the cost for robust reactor construction to provide high capacity while withstanding high pressures; and to constraints on equilibria. An additional complication is the interaction of numerous simultaneous reactions such as will be enumerated hereinbelow. Continuous-flow upgrading provides the possibility to mitigate many of these issues, even largely overcome them. By way of non-limiting example, it can in some cases involve the flowing of process fluid comprising oil and optionally one or more additional materials in a downstream direction through a reactor configured to effect deoxygenation of the oil, typically operating at elevated temperature and pressure and containing a catalyst bed.

Numerous examples of HDRD processes exist; in each, the feed includes molecular hydrogen as an additional material and a reactor configured with a catalyst suitable to promote HDO and/or DCO. By contrast, few examples exist of processes for producing renewable diesel by removal of the carboxylate group. Case 1 employs pyrolysis to decarboxylate a feed that is substantially purified FFA obtained from a fatty acid resource, e.g., by the saponification of FAGE and the subsequent removal of glycerol and other impurities in the raw oil. Optionally, nitrogen is used as an additional material in the feed, and the reactor either contains no catalyst or, optionally, an activated alumina catalyst. In Case 2, the feed is oil but each part is combined with a required additional material in a nominal ratio of 1:5 (v/v), the additional material being formic acid at a nominal concentration of 1% in water, its stated purpose being to serve as an in situ source of hydrogen for saturating C═C native to the oil. Additionally, the feed flows at very high pressure (about 3500 psi) through a reactor containing a catalyst bed of metal-free activated carbon.

Significant issues attach to the aforementioned art. The requirement in Case 1 for the feed to be substantially free of components other than FFA imposes a requirement for pre-processing of oil that contains or in large measure comprises FAGE. Moreover, the deoxygenation yield under the pyrolytic conditions employed is sufficiently low that post-processing is required to remove unconverted FFA from the product mixture. The additional requirement for nitrogen in the process feed combined with the need for pre- and post-processing impair commercial viability. In Case 2 the cost for augmenting the oil with a required additional material also is not unimportant. Yet, two other requirements are more exacting. The first concerns the cost of construction for capital equipment: high pressure and high acidity imposes demands on, respectively, mechanical design and reactor metallurgy. The second requirement relates to complications associated with the use of activated carbon as the catalyst, which will be discussed in greater detail below but generally concern a variety of modes that deactivate the catalyst and the consequential demand to regenerate or replace it.

Some problems with Cases 1 and 2 discussed above may be circumvented in certain embodiments by simply flowing a water-oil mixture through a stationary phase, which is a catalyst bed, under conditions that are isothermal at between about 350° C. and 400° C. and isobaric at relatively low pressures below about 500 pounds per square inch (psi). In one particular embodiment, Case 3, the reaction mixture is water combined with oil comprising 90% oleic acid (OA) in a preferred ratio of 4:1 ratio, the stationary phase is activated carbon, and the preferred temperature is 400° C. And in another particular embodiment, Case 4, OA or fatty acid glyceryl esters combined with water in a preferred water-oil ratio of 4:1 or 5:1 are fed into a reactor that contains a stationary phase comprising molybdenum on an alumina substrate and operates at a preferred temperature of 375° C. For convenience, these will be referred to as low-pressure thermo-catalytic deoxygenation (Low-P TCD), which should be understood for present purposes as the flowing of oil mixed with water through a reactor containing a fixed catalyst bed operating at temperatures at or above about 350° C.

In Cases 3 and 4, the decarboxylation and liquid yields are given by Equations (1) and (2), respectively. They purport to achieve moderately high decarboxylation yields of 91% to 92% while the liquid yield reported for Case 4 is rather poor at 71% and that for Case 3 is even worse at 63.5%. Those values improve somewhat to 84% and 75% with a more apt calculation that corrects liquid yield by including a factor of 0.844 in the denominator of Equation (2) to convert g OA to g heptadecane that would be obtained if 100% of the OA feed were converted to heptadecane.

$$\%\,\text{Decarboxylation(mole/mole)} = 1 - \frac{\text{Moles } OA \text{ in the Product}}{\text{Moles } OA \text{ in the Starting Material}} \times 100 = 1 - \frac{\text{g } OA \text{ in the Liquid Product}}{\text{g } OA \text{ in the Starting Material}} \times 100 \quad (1)$$

$$\%\,\text{Liquid Yield } (w/w) = \frac{\text{g Liquid Product}}{\text{g Oleic Acid Starting Material}} \times 100 = \frac{\text{g } OA + \text{g } C17}{\text{g Oleic Acid Starting Material}} \times 100 \quad (2)$$

where C17 is heptadecane, and g C17 represents the mass of saturated hydrocarbon in the product mixture.

Notice that Equation (1) explicitly calculates % Decarboxylation in terms of OA in the liquid product mixture while Equation (2) calculates yield in terms of the total liquid product mixture obtained. Thus, as poor as are the liquid yields obtained by Cases 3 and 4, values obtained by Equation (2) are unduly optimistic as the liquid yield includes unconverted FFA calculated in Equation (1). A more relevant value for product yield corrects Equation (2) to exclude unconverted OA according to Equation (3), which expresses product yield in terms of heptadecane that would be obtained if OA were to undergo quantitative decarboxylation and saturation. Note as well that because high levels of FFA in liquid product by Cases 3 and 4 are unacceptable, unconverted OA would need to be either removed or somehow converted to FAME in a post-processing step, increasing opex and capex costs.

$$\%\,\text{Product Yield*(w/w)} = \%\,\text{Liquid Yield}(100 - \%\,\text{Decarboxylation}) \quad (3)$$

*This simple equation is supported by a rigorous derivation.

Now, using 67% and 91.5% as average values, respectively, for the uncorrected % Liquid Yield and % Decarboxylation for the two Cases obtains a value of merely 58.5% value for % Product Yield by Equation (3). This value is low even if the corrected expression for % Liquid Yield were used, compounding any other economic challenges to the viability of Low-P TCD defined in prior art. This does not mean, however, that they should be dismissed out of hand, for great significance resides in the underlying reasons. These are explored in the following detailed inventory of chemistry relevant to Cases 3 and 4 specifically, and Low-P TCD generally. Though not wishing to be limited by any particular theory of operation, that inventory critically reexamines themes often recited in connection with prior art but perhaps not well understood; then it carefully applies chemical reasoning and novel insights based on results acquired through original experiments or on chemistry not previously recognized as having bearing on Low-P TCD;

and finally it integrates this information into an accounting of relevant chemistry that is novel, highly systematic, and substantially comprehensive. Those skilled in the art will appreciate that the intent is not to detail each reaction, much less their underlying mechanisms. Nonetheless, the discussion about each is sufficient to substantiate the chemical idea represented and support an accounting of the relationship between them, where such exists.

Detailed Inventory of Relevant Chemistry in Low-P TCD

Catalyst Deactivation: Microsite Erosion. When activated carbon (AC) is the stationary phase in Low-P TCD, it has been implicated as a source of molecular hydrogen, $H_2$ (or simply hydrogen), which many have supposed to be the agent for saturating native carbon-carbon double bonds in OA. In reactions well-known to those skilled in the art, elemental carbon can under certain conditions undergo steam reforming to generate carbon monoxide (CO) and $H_2$, and the CO can subsequently undergo the water-gas shift reaction to form hydrogen and carbon dioxide:

| | | | |
|---|---|---|---|
| Reforming of Carbon: | $C_{(s)} + H_2O$ | → | $CO + H_2$ |
| Water-Gas Shift Reaction: | $CO + H_2O$ | → | $CO_2 + H_2$ |
| Net Reaction: | $C_{(s)} + 2\ H_2O$ | → | $CO_2 + 2\ H_2$ |

Problematically, this in situ production of hydrogen would be to consume the catalyst, e.g., irreversibly erode microsites in the AC thought to catalyze deoxygenation, degrading catalyst activity and leading ultimately to its irreversible deactivation. Although the catalyst may be replaced or potentially regenerated by various procedures, overall commercial ramifications are negative, important among them being the yet-lower product yield that accompanies progressive degradation in catalyst activity, even after regeneration. Nonetheless, the viability of AC as a catalyst is determined principally by economics. Thus, use of AC is not precluded if it is relatively inexpensive, decarboxylation yields do not fall to unacceptably low levels, and throughput loss due to frequent replacement is acceptable.

Limited Possibility for Hydrogenation by Molecular Hydrogen. Diverse art employing hydrothermal conditions commonly invokes reactions with molecular hydrogen produced by steam reforming and the water-gas shift reaction. Applying such reasoning in Cases 3 and 4, $H_2$ has been proffered as agent for reducing unsaturations native to fatty acids such as OA. But consider the extensive evidence in the chemical literature and extant art for producing HDRD that such hydrogenation commonly depends on (i) catalysts containing precious metals such as platinum (Pt) or palladium (Pd), and (ii) the availability of hydrogen at relatively high partial and absolute pressures sufficient to achieve suitable kinetic outcomes. Conditions employed in Cases 3 and 4 fall well short of these criteria. Moreover, the prevailing pressures and temperatures in Low-P TCD are generally far lower than those commonly applied to effect the steam reforming and water-shift gas reactions. This does not mean that no molecular hydrogen is generated by these reactions, but that the amounts and their role as a reducing agent are extremely limited. This implies in turn that reduction ascribed to molecular hydrogen in Cases 3 and 4 occurs instead by some other mechanism.

Catalyst Deactivation: FFA Polymerization. Methods and chemistry for catalyzing the dimerization of fatty acids have been practiced since the mid-1900s; the dimer acid products have longstanding commercial significance. The controlled reaction of unsaturated fatty acids to yield dimers together with lesser amounts of trimers and tetramers proceeds by a variety of well-known mechanisms, e.g., bond migration and Diels-Alder reactions, when heated to temperatures of about 190° C. 220° C. in the presence of catalysts such as montmorillonite clay. The instant inventors recognized that the same chemistry is operative in the catalyst bed when OA or oils are processed according to Cases 3 and 4, a fact evidently overlooked by others for the likely reason that it has not featured prominently in the chemical literature for decades. Thus, stationary phases employed to promote thermocatalytic deoxygenation, e.g., AC or metal-doped alumina, also may also catalyze between fatty acids flowing through the reactor. And at temperatures more than 100° C. higher than those employed in commercial dimerization processes, the kinetics are even more favored to the extent that dimerization may even occur apart from heterogeneous catalysis. When the oil is an 18-carbon FFA such as OA (boiling point 360° C. at ambient pressure), linoleic acid, or linolenic acid, the dimer product is a 36-carbon di-acid, which may in turn react with other FFA to form trimers, tetramers, pentamers, etc., which are fatty acid polymers. Increases in boiling points that attend the corresponding increases in molecular weight are problematic in Cases 3 and 4. First, the polymers accumulate on the catalyst bed due to the concomitant decrease in overall mobility, blocking active sites that promote decarboxylation and potentially restricting flow.

These polymers also may undergo cracking and decarboxylation to form lower-molecular-weight hydrocarbons that contribute to the product yield. But if they do not, then their prolonged residence on the catalyst may predispose them to instead undergo decomposition to form carbon monoxide, carbon dioxide, hydrogen, low-molecular-weight hydrocarbons such as methane or ethylene, and coke. The progressive accumulation of coke and consequential deactivation of catalyst may be reversed through common catalyst regeneration techniques, e.g. decoking in the presence of air at high temperature. Such practices merely mitigate one negative effect of polymer-derived coke formation but cannot offset others including reduction in product yield, throughput due to catalyst regeneration cycles, and possibly catalyst life due to thermal cycling at elevated temperatures during regeneration.

Yield Loss Due to Cracking. A fact recognized by the instant inventors but apparently overlooked previously in connection with Cases 3 and 4 is that under the Low-P TCD conditions employed, unsaturated fatty acids may crack with relative ease between carbon atoms in the alpha and beta positions relative to native unsaturations in the fatty acid chain. The reason is that homolytic bond scission in that position produces a stabilized allylic radical such that the free radical pair has lower energy than one resulting from cracking of single carbon-carbon bonds further removed from the unsaturation:

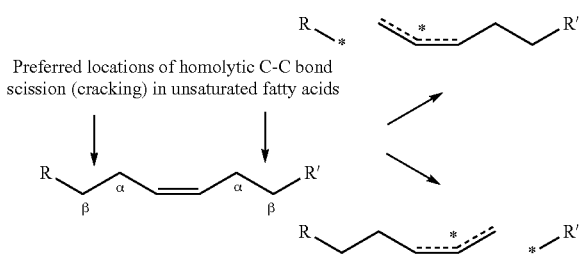

In OA, where the unsaturation is between carbons 9 and 10, the alpha/beta positions are C7/C8 and C12/C13. Cracking between those positions would produce a mixture of alkanes containing 6, 7, 10, and 11 carbons, provided the following reactions ensue after cracking: (i) quenching of the free radicals; (ii) saturation of remaining double bonds; and (iii) removal of the terminal carboxylate group. Such a sequence presupposes that hydrogen equivalents are not stoichiometrically limiting. Otherwise, hydrocarbon fragments formed by cracking may be predisposed to undergo steam reforming to form hydrogen and carbon monoxide, while the water-gas shift reaction also comes into play. Alternatively, the radicals may recombine to produce hydrocarbons with chain lengths of between 12 and 22 after decarboxylation. Note that whereas hydrocarbons containing more than 10 carbons are acceptable in diesel, hexanes and heptanes are not. In these various scenarios, cracking represents an uncontrolled side reaction that can diminish the yield from oils of diesel-range hydrocarbons.

It should be noted that Cases 1-4 all operate isothermally at elevated temperatures from as low as about 300° C. to over 400° C., with 350° C. to 400° C. being typical. Also, they operate isobarically, the pressure regime for Case 1 being 0-2000 psi with 800 psi being preferred while the pressure specified for Case 2 is 3500 psi and that for Cases 3 and 4 is less than about 500 psi. Control experiments conducted in connection with Case 3 indicate that just as in Case 1, decarboxylation of OA occurs at those temperatures even when no catalyst is present, though yields are significantly lower, e.g. about 50%. Moreover, cracking is known generally to occur under such conditions, just as it does in Case 1. Catalysts can exacerbate the problem to the extent that they do not selectively foster decarboxylation, but also promote cracking of unsaturated fatty acids as described above. The cracking of hydrocarbon chains therefore is an ever-present threat to product yield under thermo-catalytic conditions for producing renewable diesel.

The Role of Water in Low-P TCD. In certain embodiments for producing renewable diesel by Low-P TCD where the oil is OA, the highest yields for decarboxylation, for liquid product, and for heptadecane as a percentage of hydrocarbon compounds in the liquid product are obtained for water-oil ratios that are about 4:1 or higher, compared with ratios of about 3:1 or less. The explanation offered is that higher concentrations of steam foster more hydrogen production by the reforming and water-gas shift reactions that convert hydrocarbons in the process stream to molecular hydrogen, which once again is invoked as a reducing agent. Yet, a point already made is that even though hydrogen may be produced, that does not mean it necessarily participates in reactions. The possibility for involvement by water in the catalytic mechanism for decarboxylation, or in the suppression of cracking, cannot be ruled out. But the higher yields can be explained much more simply. First, consider that OA, which has a boiling point of 361° C. at ambient pressure, is representative of a large number of 18-carbon fatty acids found in oils, others including stearic, linoleic, and linolenic acids. Suppose also that (i) OA is fed into a flow-through reactor containing a stationary phase, (ii) a modest back-pressure exists at an upstream portion of the reactor, and (iii) the temperature of the reactor is nominally that employed in Low-P TCD, e.g., less than about 400° C.

While wishing to not be bound by a particular theory of operation, much of the OA in that upstream portion of the reactor may be supposed to exist as a liquid deposited on the stationary phase at nominal temperatures and relatively low pressures. Consequently, movement of the oil across stationary phase surfaces can be explained as being motivated by the mass flow of water vapor functioning as a carrier gas. This likelihood becomes clear in light of the fact that, in accordance with the ideal gas law, each milliliter of liquid water feed vaporized at the reactor inlet expands by a factor of about 87 when P=500 psi and T=375° C. The localized pressure in the stationary phase then decreases progressively along the length of the downstream flowpath through the reactor such that the expansion factor for water increases to about 3000 at the outlet if P=1 atmosphere (1 atm, or about 15 psi).

Suppose now that (i) the pressure drop along the stationary phase were negligible such that the inlet and outlet pressures were both about 1 atmosphere, and (ii) upon injection of a 4:1 water-oil mixture (w/w) into a reactor operating at 375° C., both the water and the oil are quantitatively vaporized. Because the molecular weight of water is a factor of 16 lower than that of OA, the volume of water vapor flowing through the reactor is about 63-71 times greater than the volume of vaporized OA. But at slightly higher pressures where OA may be substantially in the liquid phase, those volume ratios increase dramatically. For example, at 500 psi, volume ratio between water vapor and liquid OA is about 350. In short, water functions somewhat in analogy with a carrier gas in gas chromatography. Reducing the water-oil ratio to 2:1 reduces that flow-rate factor by half, which would serve to double the residence time of the fatty acids and decarboxylation products in the reactor. Supposing that the rates for cracking do not differ significantly from those for decarboxylation because they are determined kinetically rather than thermodynamically, then the longer residence times (lower flow rates for vapor-phase water) can be expected to reduce the product yield in alkanes with chain lengths corresponding to those of decarboxylated fatty acids. That is, the amounts of shorter overall chain lengths would increase. Thus, in embodiments for effecting Low-P TCD as described for Cases 3 and 4, high quantities of water relative to oil apparently serve principally to provide a mobile phase that motivates the movement of oil through the stationary phase such that net residence times are suitable to promote thermo-catalytic deoxygenation while minimizing undesirable cracking.

Thermodynamic Penalty for Vaporizing Water. Despite the aforementioned benefit of high water-oil ratios, it is accompanied by a corresponding thermodynamic penalty associated with vaporization of water. Even though some fraction of the heat of heat can be recovered from the product exiting the reactor, the entropy increase upon vaporization means that some portion of energy invested to generate the gas-phase "carrier stream" from liquid water cannot be recovered by heat recovery techniques. Thus, this entropic penalty can be reduced in proportion to the reduction in the oil-water ratio, e.g. it can be reduced by half if the ratio is reduced from 1:4 to 1:2.

A Plurality of Reactions. A variety of reactions are commonly adduced to explain the results observed for Low-P TCD of oil. But as identified in the foregoing discussion, some may lack plausibility, e.g., hydrogenation by molecular hydrogen. Yet, other reactions of import have been overlooked altogether in prior art, e.g., catalyst microsite erosion, polymerization of fatty acids, and facile but undesirable cracking at positions proximate to native unsaturations in hydrocarbon chains of fatty acids. Beyond a mere accounting of reactants and products, the instant system and method for Low-P TCD of oils is based on a full-orbed inventory of substantially all intervening chemistries. Additionally, explanations for outcomes of prior-art Low-P TCD do not contemplate comparative kinetics for, and the relationship between, the plurality of reactions occurring simultaneously in the reactor as feed and products flow through the stationary phase. Rather than rely on cliché chemical constructs, the present inventors recognized that overcoming the limitations of current Low-P TCD art depends on a more reasoned and thorough inventory of the prevailing chemistry, which also serves to elucidate the novelty and efficacy of the instant invention.

Low-P TCD Reactions. Table I presents a thorough inventory of nine reactions believed to be representative of substantially all relevant chemistries occurring under Low-P TCD conditions. It begins with oil that is a glyceryl ester because commercial relevance precludes processes limited to FFA such as Cases 1 and 3. Examples in Table I are nonlimiting. For example, in the polyunsaturated fatty acids given in Reactions D3, the carbon-carbon double bonds occur as methylene-interrupted (non-conjugated) series. And the polymerization Reaction U3 is shown for a single unsaturated fatty acid, whereas many oils contain both mono- and polyunsaturated fatty acids of varying chain lengths, all of which can undergo polymerization with the others. Further, Reaction U4 depicts the consumption of an entire fatty acid molecule to form carbon dioxide and hydrogen equivalents [H] while the possibility exists that only a portion of such a molecule may be consumed.

Though wishing to not be bound by any particular theory of operation, the desirable reactions are presented in Table I in the order of their tendency to occur. More particularly, the first and second groups of Desirable Reactions D1-D3 and D4-D6, respectively, occur in order of their reactions' proclivity on the grounds of thermodynamic considerations. Overall, the Undesirable Reactions U1-U5 also are not expected to occur as readily as D1-D3, the possible exception being the polymerization indicated in U2. In prior-art Cases 3 and 4, where oil and water flow through a reactor controlled at a fixed temperature between 375° C. and 400° C., kinetics may be expected to overtake thermodynamics, suppressing the thermodynamically-determined ordering of the two groups of Desirable Reactions such that they may tend to occur substantially simultaneously along with the Undesirable Reactions; or at least their inherent sequentiality will be diminished. Then, the only absolute constraint on reaction sequence is imposed when a reactant in one is the product of another, e.g., hydrogen equivalents consumed in Reactions D3, U1, U3, D5, and D6 must first be produced by Reactions D2 and/or U4. Note that Reaction U3 is not the sole source of coke formation, but that deposited polymers (Reaction U3) inevitably will undergo coking, as can hydrocarbon fragments generated by Reaction U1. And, as will be discussed but is not denoted in Table I, Reaction U5 may also lead to coke production.

TABLE I

REACTIONS INVOLVED IN THE CONVERSION OF OIL TO PRODUCT BY LOW-PRESSURE THERMO-CATALYTIC DEOXYGENATION (LOW-P TCD)

| | | | | |
|---|---|---|---|---|
| Fatty Acid Glyceryl Ester Hydrolysis: | $CH_2(OR_1)CH(OR_2)CH_2(OR_3) + 3\ H_2O$ | → | Glycerol $C_3H_8O_3$ + $R_1OH + R_2OH + R_3OH$ | (D1) |
| Reforming of Glycerol: | $C_3H_8O_3 + 3\ H_2O$ | → | $3\ CO_2 + 14$ [H] | (D2) |
| Saturation of Native Double Bonds in Free Fatty Acids: | $R_4CH_2CH{=}CH(CH_2)_xCOOH + 2$ [H] | → | $R_4(CH_2)_{x+3}COOH$ | (D3) |
| | $R_5CH_2CH{=}CHCH_2CH{=}CH(CH_2)_xCOOH + 4$ [H] | → | $R_5(CH_2)_{x+6}COOH$ | |
| | $R_6CH_2CH{=}CHCH_2CH{=}CHCH_2CH{=}CH(CH_2)_xCOOH + 6$ [H] | → | $R_6(CH_2)_{x+9}COOH$ | |
| Cracking between Carbons α and β to Unsaturations: | R—CH2CH2CH=CHCH2CH2—R' + 4 [H] | → | Shorter-chain Alkanes and Fatty Acids | (U1) |
| Polymerization and Reduction: | $n\ C_yH_{2(y-z)+1}COOH + 2z$ [H] | → | $[C_yH_{y-z}COOH]_n$ | (U2) |
| Cracking of Fatty Acids (and Fatty Acid Polymers): | $C_yH_{2(y-z)+1}COOH$ | → | CO, $CO_2$, $H_2$, [H], coke, lower-MW hydrocarbons | (U3) |
| Steam Reforming of Fatty Acids: | $C_yH_{2(y-z)+1}COOH + 2y\ H_2O$ | → | $(y + 1)\ CO_2 + (6y - 2z + 2)$ [H] | (U4) |
| Dehydration of Glycerol: | $CH_2(OH)CH(OH)CH_2(OH)$ | → | $CH_2{=}CHCO + 2\ H_2O$ | (U5) |
| Decarboxylation: | $RCH_2CH_2COOH$ | → | $RCH_2CH_3 + CO_2$ | (D4) |
| Decarbonylation: | $RCH_2CH_2COOH$ | → | $RCH{=}CH_2 + CO + H_2O$ | |
| Reduction of Terminal Alkenes: | $RCH{=}CH_2 + 2$ [H] | → | $RCH_2CH_3$ | (D5) |
| Hydrodeoxygenation: | $RCH_2CH_2COOH + 6$ [H] | → | $RCH_2CH_2CH_3 + 2\ H_2O$ | (D6) |

where $R_1$, $R_2$, and $R_3$ are either hydrogen or fatty acyl chains associated with fatty acids R and R' are, respectively, n-alkyl and carboxylate-bearing groups associated with fatty acids $R_4$, $R_5$, and $R_6$ denote alkyl chains that may be of the same or different lengths

[H] denotes neither atomic nor molecular hydrogen, but hydrogen equivalents, e.g., the availability of reducing equivalents that are stoichiometrically equivalent to atomic hydrogen y = the number of carbon atoms in the hydrocarbon chain adjoined to the carboxylate group in a fatty acid or the average value for a mixture of fatty acids z = the number of unsaturations in a fatty acid molecule, or the average number of unsaturations in a mixture of fatty acids D1, D2, D3, D4, D5, and D6 are Desirable Reactions U1, U2, U3, U4, and U5 are Undesirable Reactions Detailed Discussion of Reactions Reaction D1. Hydrolysis of glyceryl esters of fatty acids to obtain glycerol and FFA is known to occur readily at temperatures considerably lower than those employed in Low-P TCD art, e.g., below 300° C. When the reactant is a triacyl glycerol, e.g., a fatty acid triglyceride, the products $R_1OH$, $R_2OH$, and $R_3OH$ are free fatty acids, where $R_1$, $R_2$, and $R_3$ are fatty carbonyl moieties that have the general formula RCO—but can differ with respect to the length and the number and positions of unsaturations in the hydrocarbon chain, R. When any combination of two, one, or none of $R_1$, $R_2$, and $R_3$ in the glyceryl reactant $CH_2(OR_1)CH(OR_2)CH_2(OR_3)$ is hydrogen, the reactant is a mono-, di-, or tri-glyceride, respectively.

Reaction D2. Steam Reforming refers to the reactions whereby compounds having the general formula $C_uH_vO_w$ undergo a decomposition reaction with water to form a syn-gas comprising $H_2$ and carbon monoxide while the water-gas shift reaction concerns the further reaction of each mole CO with a mole of water to form $CO_2$ and $H_2$ (Table II). Carbon is essential in all cases while the integer values v and w may include zero. For activated carbon, v=w=0 while both are non-zero for glycerol and fatty acids (Reaction U4). In hydrocarbon reforming (v≠0 and w=0), the objective is to efficiently produce large quantities of molecular hydrogen by steam reforming, the temperature-pressure regime is considerably more severe than in Low-P TCD. Evidence of a reducing environment in cases 3 and 4 therefore suggests a net reaction D2c that may or may not proceed according to the D2a-D2b sequence but nevertheless makes reducing equivalents [H] available in the form of one or more reactive intermediate.

TABLE II

REFORMING REACTIONS PRODUCING HYDROGEN EQUIVALENTS FROM OXYGENATED HYDROCARBONS $C_UH_VO_W$.

| | | | | |
|---|---|---|---|---|
| Syn-Gas Production: | $C_uH_vO_w + (u - w)\ H_2O$ | → | $u\ CO + (2u + v - 2w)\ [H]$ | (D2a) |
| Water-Gas Shift Reaction: | $u\ CO + u\ H_2O$ | → | $u\ CO_2 + 2u\ [H]$ | (D2b) |
| Net Reforming Reaction: | $C_uH_vO_w + (2u - w)\ H_2O$ | → | $u\ CO_2 + (4u + v - 2w)\ [H]$ | (D2c) |

Note:
[H] denotes hydrogen equivalents and 2 [H] is equivalent to $H_2$ stoichiometrically but not necessarily chemically. That is, the chemical form and reactivity of [H] may be different from that of $H_2$.
In the case of glycerol ($C_3H_8O_3$), equation D2c becomes, $C_3H_8O_3 + 3\ H_2O \rightarrow 3\ CO_2 + 14\ [H]$.

Reactions D3. Hydrogenation involving $H_2$ has been invoked in connection with Cases 3 and 4 to explain lower levels of unsaturation in the deoxygenated product than in the corresponding fatty acid feed. Yet, as discussed previously, Low-P TCD conditions do not satisfy the threefold requirement for this to occur, e.g., catalysts containing Pt or Pd, high pressure, and high concentrations of $H_2$. The instant inventors recognized this implies that reduction of native unsaturations in fatty acids depends on the availability of [H] in a chemical form other than $H_2$. Reactions D3 depict by way of non-limiting illustration the saturation of fatty acids with one, two, and three methylene-interrupted unsaturations. In the case where all three fatty acids have 18 carbons, the 18:1, 18:2, and 18:3 substrates are oleic, linoleic, and linolenic acid, respectively, where the numbers 1, 2, and 3 denote the number of unsaturations in the hydrocarbon chain. In each case, addition of two hydrogen equivalents [H] to each carbon-carbon double bond yields the same saturated product, which is stearic acid.

Reactions D4. These reactions depict by way of nonlimiting example the elimination of the carboxylate group of free fatty acids by decarboxylation to yield carbon dioxide and the saturated hydrocarbon product or by decarbonylation to yield carbon monoxide plus an intermediate terminal alkene. As discussed above, these deoxygenation reactions can occur at temperatures relevant to Low-P TCD art, e.g., 350° C. to 400° C., and may to some degree occur even without the aid of catalyst. The known high activation energy for these reactions means that in general they occur under pyrolytic or thermo-catalytic conditions. In this discussion, the elimination of oxygen has heretofore been referred to principally in terms of decarboxylation, mainly because of its predominant use in connection with prior art, apparently on the grounds that the preponderant production of $CO_2$ was regarded as evidence for decarboxylation over decarbonylation. However, as will be discussed below, that observation also can be attributed to Undesirable Reactions whose significance was not fully appreciated in prior art. The term deoxygenation will be used hereinafter to denote elimination of oxygen from fatty acids by reactions including but not limited to decarboxylation and decarbonylation.

The present inventors made the significant discovery that the deoxygenation yield under Low-P TCD conditions including catalyst is 50% for a feed mixture comprising saturated fatty acid, e.g., stearic acid, and water without a source of [H], e.g., glycerol. This result is similar to results reported in connection with Case 4 for processing of oleic acid (OA) under Low-P TCD conditions in the presence of water (e.g., oil:water, 1:4) but without catalyst. Yet significantly, the inventors also found that inclusion in the S2 feed mixture of about 4% to about 10% glycerol (weight basis) versus stearic acid (oil:water also about 1:4) obtained much higher deoxygenation yields under the same conditions, e.g. greater than about 90%. In yet another important experiment, the inventors observed unexpectedly that a similar increase in deoxygenation yield was not obtained with less than about 10% OA versus stearic acid in the feed mixture (oil:water again about 1:4 but no glycerol), but only at OA levels greater than about 20% where equilibria begin to foster appreciable interaction of the latter with those sites. Though wishing to not be limited by any particular theory of operation, these results suggest that glycerol is readily transformed under Low-P TCD conditions into chemical species able to facilitate deoxygenation reactions, whereas OA is not. This may be explained straightforwardly if (i) the selfsame active sites on the stationary phase that catalyze deoxygenation also promote cracking and reforming of unsaturated fatty acids; (ii) the affinity of carboxylic acid groups for those sites is much higher than is that of alkenic functionality in the fatty acid chains such; and (iii) the aforementioned transformation of glycerol occurs substantially independent of those sites. Significantly, this explanation suggests why cracking may be rampant in Cases 3 and 4 where the feed is 100% OA. The significance of these discoveries will be discussed further below.

Reaction D5. The terminal alkenes reduced in this reaction are those produced in Reaction D4. Under conditions where the predominant mode of deoxygenation is decarboxylation, Reaction D5 is unimportant, but the possibility also exists to reduce any residual unsaturations native in the FFA, which were not saturated in Reactions D3. Both reactions are conditioned upon the quantities of [H] being non-limiting.

Reaction D6. Catalytic reduction of the carboxylate group by this reaction is central to HDRD production while in Low-P TCD the objective is its removal as $CO_2$. Nevertheless, hydrodeoxygenation (HDO) in the context of Low-P TCD is not precluded, although for reasons discussed it is unlikely to proceed by agency of molecular hydrogen, $H_2$. Reaction D6 could be favored on kinetic grounds to the extent that the concentration of [H] produced in Reaction D2 is relatively high and/or the chemical form of [H] is particularly reactive under conditions employed for Low-P TCD.

Reactions U1 and U3. Cracking occurs readily with and without catalysts at temperatures above about 350° C., and especially above about 365° C., to generate products well known to those skilled in the art, such as those indicated. Factors well known to chemists favor the initiation of cracking between α- and β-positions relative to native unsaturations. If resulting radicals are not quenched and unsaturations reduced as depicted in Reaction U1 or by recombining with each other (not shown), the possibility exists for decomposition to continue, yielding products given for Reaction U3. All are produced at the expense of yield in the desired diesel-grade alkanes corresponding to hydrocarbon chains of oil. An additional consequence of Reaction U3 is the progressive accumulation of coke on the catalyst bed and a corresponding diminishing of catalytic activity.

Reaction U2. The propensity of unsaturated fatty acids to undergo polymerization was identified above, as was the possibility for the polymers to subsequently form decomposition products as depicted for FFA in Reaction U3. Compared with commercial dimer acid production processes designed to limit formation of trimers and tetramers, uncontrolled polymer formation would be expected to occur under Low-P TCD conditions employed in Cases 3 and 4. Reasons apparently not previously understood in connection with Low-P TCD include not only higher catalyst activity and temperatures, but also the relatively low liquid hourly space velocity (LHSV).

Reaction U4. Reforming is thoroughly discussed in connection with Reaction D2. The possibility exists that Reactions U1 and U3 generate intermediate products (not shown) that are predisposed to undergo reforming. In particular, and as discussed hereinabove, unsaturated fatty acids are believed to be predisposed to crack in chain positions proximate to double bonds to form intermediate radicals. If not quenched by addition of a hydrogen atom or by combination with some other hydrocarbon radical to form an unsaturated intermediate, and if not subsequently reduced to eliminate unsaturations, then the possibility exists for either the radicals or the intermediates to undergo continued cracking. Not wishing to be bound by any particular theory of operation, the present inventors recognized that conditions favoring Low-P TCD also can promote the Undesirable Reactions generally, and the net reforming of unsaturated fatty acids specifically. By way of nonlimiting example, when the fatty acid is oleic acid (OA, $C_{18}H_{34}O_2$), Equation D2c becomes, $$\text{Net Reforming of OA: } C_{18}H_{34}O_2+34H_2O \rightarrow 18CO_2+102[H] \quad \text{(D2c')}$$

Due to the higher C:O ratio of OA compared with glycerol (9 versus 1), the reforming of OA consumes more water per mole carbon compared with glycerol and produces more [H] per mole carbon (5.7 versus 4.7). The fact that each molecule of OA produces 102 hydrogen equivalents [H] versus 14 for glycerol suggests that to the extent OA and other unsaturated fatty acids in renewable oil undergo reforming, they represent a significant source of [H] in Low-P TCD.

Reaction U5. The instant inventors also discovered an outcome not discussed previously in connection with prior art, which results in the formation of coke. At elevated temperatures used in Low-P TCD, glycerol is known to undergo dehydration according to Reaction U5 to form propenal, whose common name is acrolein.

Propenal (Acrolein), $C_3H_4O$

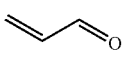

Indeed, the production of propenal by that reaction is responsible for characteristic acrid smell associated with overheating of vegetable oil and beef fat to its smoke point during cooking. In a control experiment wherein the feed into a reactor comprised only a solution of glycerol in water, that same smell along with formation of significant quantities of coke on the stationary phase was observed. That result can be readily interpreted as being consistent with propenal production by Reaction U5 followed by the formation and subsequent thermal cracking of polypropenal, where the latter forms because propenal is an α,β-unsaturated carbonyl compound whose carbon-carbon double bond is activated by the adjacent carbonyl and therefore has relatively high reactivity compared with that of simple alkenes, predisposing it to undergo polymerization. High-molecular-weight products thus formed may, as in the case of Reaction U3, accumulate on the stationary phase, leading ultimately to the formation of coke. Thus, Reaction U5 should be understood as the precursor to polymerization and coke formation.

Implications for Process Optimization. Though wishing to not be bound by any particular theory of operation, the discovery that decomposition products of OA and glycerol play a beneficial role in deoxygenation of stearic acid (see the discussion above on Reaction D4) suggests that deoxygenation is facilitated by materials including but not limited to glycerol and unsaturated fatty acids, and/or products from their decomposition, e.g., products of Reactions D2, U3, U4, and U5; and absent such materials, the deoxygenation mechanism in the presence of catalyst may be the same as when none is present. But regardless of the exact mechanism, the unambiguous implication is that Low-P TCD occurs by agency of water and catalyst in combination with decomposition products from compounds with the general formula $C_uH_vO_w$. The results also imply that Reactions U1, U3, and U4 occur principally when (i) the amount of glycerol, or the amount of other oxygenated additional material injected into the reactor, is limiting; and (ii) the ratio of saturated fatty acids to unsaturated fatty acids in the S2 feed is relatively low. Finally, it also suggests that maximizing liquid yield depends on the substantial but not necessarily the quantitative reduction of unsaturations in fatty acids before being subjected to Low-P TCD conditions.

Prior art Case 4 altogether failed to understand that products from decomposition of OA under Low-P TCD conditions may directly facilitate deoxygenation, or that decomposition products from glycerol and unsaturated fatty acids in FAGE such as CDO may do the same. While such decomposition is inherent in Case 4, none before the instant inventors recognized this fact or, more importantly, that maximizing the total liquid yield of deoxygenated hydrocarbons from oil feed, and minimizing coke formation, depends therefore on (i) deliberate reduction of native unsaturations in the oil feed prior to their subjection to catalytic deoxygenation; and (ii) deliberate control of process conditions to provide [H] from sources other than unsaturated fatty acids in quantities sufficient to maximize catalytic deoxygenation of fatty acids.

Overcoming Limitations of Prior Art. The preceding examination of desirable and undesirable reactions germane to production of HTRD by Low-P TCD is unprecedented in thoroughness and depth. It is comprehensive, identifying not merely the reactions habitually cited in connection with prior art, but scrutinizing their plausibility while also bringing into view new chemistries or those which were known but hitherto not understood to have bearing on Low-P TCD, e.g. polymerization of fatty acids, the formation and reaction of propenal, and promotion of thermocatalytic deoxygenation by decomposition products from glycerol and fatty acids originating in the oil. Furthermore, the inventory of chemistries is unprecedentedly coherent insofar as it systematically organizes them to provide novel and nonobvious insights regarding the significance of, conditions for, and relationships between reactions. It therefore is not merely diagnostic for the shortcomings of prior art, but effectively provides a framework for defining embodiments of a system and method more favorable for producing HTRD by Low-P TCD than has been contemplated hitherto.

Characteristics of prior Low-P TCD art may be summarized as follows: a liquid process fluid comprising oil mixed with water flows through an inlet at the upstream end of a heated reactor comprising a single section filled with a catalyst; the reactor is operated isothermally at a temperature between about 360° C. and 420° C.; the pressure at the outlet is determined by ambient pressure and generally is below about 500 psi; all of the reactions in Table I together with others considered in the Detailed Discussion of Reactions occur substantially concurrently, e.g., Reactions U1-U5 and D4-D6 may occur on time scales similar to those for Reactions D1-D3 because rates may be determined kinetically rather than thermodynamically at the high temperature, which is to say that the elevated temperatures drive all reactions at high rates by diminishing the importance of thermodynamic effects pronounced at lower temperatures; and water is required in quantities that significantly exceeds the stoichiometric demand by the Desirable Reactions, apparently serving an additional, non-chemical role as a vehicle for mass transport to minimize long residence times that produce cracking of fatty acids and products in the reactor. The consequential shortcomings include loss of liquid yield and/or high rates of coke formation due to Reactions U1-U5, which to a great extent are due to presence in the oil the liquid of unsaturated fatty acids and of glycerol where the oil is FAGE, while the excessive amounts of water carry an energy penalty.

Understanding the inherent issues and limitations of prior art for upgrading oil, the inventors of the instant system and method for upgrading oil recognized the need and previously unforeseen possibility for a more facile Low-P TCD approach to produce HTRD by minimizing U1-U5 through the initial promoting of D1-D3 substantially selectively and quantitatively before subjecting the process mixture to conditions favorable for D4-D6. Accordingly, the following is a detailed description of the instant invention and embodiments thereof for accomplishing this by means altogether novel and non-obvious, and whose distinctiveness and advantages relative to prior art will also be apparent.

Detailed Description of Embodiments of the Invention

Embodiments of the instant invention achieve upgrading of renewable oil by first promoting substantially exclusively and quantitatively a plurality of First Desirable Reactions D1-D3 to obtain a product mixture that contains free fatty acids that are substantially saturated (FFA/sat), then optionally achieve further upgrading the FFA/sat by promoting a plurality of Second Desirable Reactions D4-D6 to substantially deoxygenate the FFA/sat and obtain hydrocarbon fuel in high yield, where embodiments that promote the Desirable Reactions D1-D6 also minimize or substantially prevent a plurality of Undesirable Reactions U1-U5 that otherwise would reduce the yield of hydrocarbon fuel. The embodiments provide a system and method comprising the following:

(a) Configuring a flowpath to continuously convey a process fluid into and through a reactor, the process fluid consisting of renewable oil and water; and (b) Configuring the reactor as a tube whose length is between about 8 and about 80 times its inside diameter to permit flow therethrough of the process fluid in a downstream fashion from the primary inlet; and (c) Introducing the process fluid at a primary inlet to the furthest-upstream portion of the reactor; and (d) Optionally introducing into the reactor one or more additional materials at the primary inlet and/or at one or more inlets to the reactor downstream from the primary inlet such that they combine with the process fluid and flow with it in a downstream fashion through the reactor; and (e) Optionally configuring the reactor, which is a reactor section, with subsections; and (f) Optionally configuring the reactor by filling it or at least one of its subsections with one or more different materials selected to permit flow therethrough of the process fluid, which materials may be referred to as a fixed bed or as a stationary phase; and (g) Configuring the reactor including any constituent subsections to heat and to control the temperature of the stationary phase, if present, and the process fluid flowing therethrough within a first temperature range TRange1, which is within the range TRange/S1 of between about 250° C. and about 365° C.; and (h) Controlling pressure at the outlet from the reactor to main pressure above about 1200 psi where water in the flowing process fluid exists substantially as a vapor in the reactor, or optionally controlling the pressure at a level where water in the flowing process fluid exists substantially as a liquid in the reactor; and (i) Configuring the reactor to convey oil in the process fluid flowing therethrough at a net rate of between about 0.1 and about 25 times the quantity V(r)/hour where V(r) is the volume of the reactor; and (j) Selecting the optional stationary phase(s), the one or more additional materials introduced into the reactor, TRange1, the pressure in the reactor, and the rate at which oil in the process liquid flows therethrough, to promote the plurality of First Desirable Reactions D1-D3 and substantially minimizing Undesirable Reactions U1-U5, thereby obtaining at the outlet from the furthest-downstream portion of the reactor a product mixture containing free fatty acids that are substantially saturated (FFA/sat); and (a') Optionally configuring the reactor with a second section (S2), which is communicably coupled to, and downstream from, the first section (S1); and (b') Configuring S2 as a tube whose length is between about 8 and about 80 times its inside diameter to permit flow therethrough of the process fluid in a downstream fashion from the primary inlet; and (c') Configuring S2 to receive the S1 product stream through a primary inlet at the furthest-upstream portion of S2, which product stream is the process fluid containing FFA/sat; and (d') Optionally introducing into S2 one or more additional materials at its primary inlet and/or at one or more inlets to the reactor downstream from the primary inlet such that they combine with the process fluid and flow with it in a downstream fashion through the reactor; and (e') Optionally configuring S2 with subsections; and (f) Configuring S2 by filling it or its subsections with one or more different materials selected to permit flow therethrough of the process fluid, which materials may be referred to as a fixed bed or as a stationary phase; and (g') Configuring S2 to heat and to control the temperature of the stationary phase and the process fluid flowing therethrough within a second temperature range TRange2, which is within the range TRange/S2 of between about 325° C. to about 425° C., where the minimum temperature corresponding to TRange2 is about the same as or higher than the maximum temperature corresponding to TRange1; and (h') Controlling pressure at the outlet from S2 at a level sufficient to permit water in the flowing process fluid to exist substantially as a vapor in the reactor, or optionally controlling the pressure at a level where water in the flowing process fluid flowing through an upstream subsection exists in whole or in part as a liquid while that flowing through a downstream subsection exists substantially as a vapor, where those pressures are determined in consideration of the minimum and maximum temperatures in TRange2; or (i') Configuring S2 to convey oil in the process fluid flowing therethrough at a net rate of between about 0.1 and about 25 times the quantity V(r)/hour where V(r) is the volume of the reactor; and (j') Selecting the stationary phase(s) in S2, the one or more additional materials introduced into S2, TRange2, the pressure in S2, and the rate at which oil in the process liquid flows therethrough, to promote the plurality of Second Desirable Reactions D4-D6 and substantially minimizing Undesirable Reactions U1-U5, thereby substantially deoxygenating FFA/sat and obtaining in high yield a hydrocarbon fuel at the outlet from the furthest-downstream portion of S2.

TABLE III

OVERVIEW OF EMBODIMENTS AND OUTCOMES THEY ACHIEVE.

| Embodiment | Section 1 (S1) | Section 2 (S2) |
|---|---|---|
| Feed | Oil:Water mixtures | Section 1 product |
| TRange/S1 and /S2 | 250° C.-365° C. | 325° C.-425° C. |
| Stationary phase | None; optionally metal particles or catalyst | Catalyst (required) |
| Minimum pressure in particular embodiments | 1200 psi | Ambient |
| Pressure preferred in particular embodiments | >1800 psi to about 2875 psi | About 500 psi |
| Phase of water in process in particular embodiments | Vapor; optionally liquid in an upstream subsection or in the entirety of S1 | Vapor; optionally liquid in an upstream subsection |
| Reactions Promoted | D1-D3 | D4-D6 |
| Product of Interest | Saturated free fatty acids (FFA) | Deoxygenated FFA, e.g. hydrocarbon fuel |

In particular embodiments, oil is a renewable oil resource derived from non-fossil-fuel sources selected from the group consisting of but not limited to animals, plants, vegetables, fruits, grains, seeds, algae, plankton, and the like, and includes one or more materials taken from the group including but not limited to corn distillers oil (CDO); fatty acid glyceryl esters (FAGE) including mono-, di-, and triacylglycerols (TAG); and free fatty acids (FFA).

In other particular embodiments, the water-oil ratio in the process fluid is between about 1:5 and about 5:1 while in preferred embodiments the ratio is between about 1:4 and 4:1, and in highly preferred embodiments the ratio is between about 1:3 and 3:1, where the amount of water is that in excess of the quantity consumed in favorable reactions involved with upgrading.

In some situations, the amount of latent glycerol in the oil may be limiting. That is, the hydrogen equivalents [H] generated in D2 from glycerol liberated in D1 may be insufficient to subsequently meet the stoichiometric demand in upgrading reactions such as D3, D5, and D6. Therefore, in other particular embodiments, an additional material is glycerol or a solution of glycerol in water introduced at the reactor inlet and/or at one or more points in the reactor downstream from the inlet. This "makeup" glycerol is added in an amount such that when combined with that obtained with the oil feed, total [H] produced by D-2 is sufficient to not be stoichiometrically limiting in subsequent upgrading reactions. Moreover, care is exercised to ensure that the amount of water in the process fluid is adequate to support hydrolysis or reforming reactions, e.g., D1 and D2. In yet other particular embodiments the added glycerol provides a quantity of [H] that exceeds the stoichiometric demand in upgrading reactions by between about 0.5% and about 25%. In preferred embodiments the excess of [H] is between about 0.5% and about 15%, and in highly preferred embodiments the added glycerol provides [H] in a stoichiometric excess of between about 0.5% and about 5% versus [H] the demand in upgrading reactions.

Methods available to estimate the demand for [H] and water or the amount of glycerol in the oil feed will be obvious to those skilled in the arts of process chemistry, process engineering, or process analysis. Possibilities include: data obtained with conventional laboratory test methods such as those promulgated by AOAC International and with commonplace techniques for online analysis such as near-infrared (NIR) and Raman spectroscopy; application of such online monitoring technologies at the outlet from S1 and/or S3 to assess important qualities of products in the process fluid; and use of any/all such information as inputs to enable feedback control of glycerol in a model predictive control (MPC) scheme.

And in still other particular embodiments, additional material or a mixture of materials other than glycerol may be introduced at the reactor inlet and/or at one or more points in the reactor downstream from the inlet. Like glycerol, such materials have the general formula $C_uH_vO_w$, serve as a source of hydrogen equivalents [H] upon undergoing reforming according to D2c, and may be constituted as an aqueous solution. By way of nonlimiting example, the material comprises one or more compounds selected from the group including but not limited to polyols including glycerol, ethylene glycol, propylene glycol, propane diol, butane diol, butane triol, glycerol, pentaerthritol, polyethylene glycol, polypropylene glycol, and the like; alcohols such as methanol, ethanol, propanol, etc.; sugars and other carbohydrates; and various types of oxygen-containing organic compounds in biomass-derived components such as those obtained by pyrolysis of cellulose, hemicellulose, and lignin, including but not limited to organic acids, esters, alcohols, aldehydes, ketones, furans, dehydrated carbohydrates, and the like. However, aldehyde, ketone, and carboxylic acid functionality in such compounds may be expected to yield $CO_2$ directly by D2c, which contributes no reducing equivalents (carboxylate), or consumes them (e.g. upon oxidation of ketones and aldehydes to a carboxylate).

In yet other particular embodiments the additional material injected into S2 at or near the inlet thereto, or into the process fluid flowing thereinto from S1, is oil in an amount sufficient to provide a quantity of hydrogen equivalents [H] in accordance with D2c' to support the thermocatalytic deoxygenation of fatty acids. The oil may be saturated and unsaturated fatty acids; FAGE containing saturated and unsaturated fatty acids; or FAGE containing saturated and unsaturated fatty acids that have been hydrolyzed to obtain glycerol and FFA. By way of nonlimiting example, the amount of saturated fatty acids in an oil such as CDO may be between about 10% and about 15%, the balance of the fatty acids having one or more unsaturations. When the process fluid flowing into S2 from S1 contains fatty acids that have been substantially saturated in S1, then the injection into S2 of oil as the additional material serves to promote deoxygenation reactions. To appreciate the potential benefit of using FAGE instead of, for example, glycerol, suppose that the FAGE is triolein (glyceryl trioleate, the triglyceride wherein the three fatty acids are oleic acid). The number of hydrogen equivalents [H] per gram in triolein is about 2.4 times greater than in glycerol. Thus, the use of renewable oil instead of glycerol as a source of [H] in S2 may be economically advantageous though counterintuitive, depending on the amount of saturated fatty acids in the renewable oil and also the relative [H]-equivalent-basis cost of the oil compared with glycerol. If so, then in particular embodiments, S2 may be configured with a second inlet in addition to that receiving process fluid from S1, the second inlet receiving the output from a reactor not in series with S1 and configured to deliberately promote U4 on feed comprising a mixture of oil and water.

In particular embodiments, the stationary phase filled in the reactor is one or more catalysts suitable for promoting desirable reactions including but not limited to (i) the reforming of oxygenated compounds $C_uH_vO_w$ to produce hydrogen equivalents [H] according to D2c; (ii) the reduction of unsaturations native to fatty acids in the oil according to D3; (iii) the deoxygenation of the carboxylate group in fatty acids in the oil according to D4; and (iv) reduction of any terminal unsaturations formed by decarbonylation of fatty acids in the oil according to D5. The catalyst in particular embodiments is activated carbon (AC) or optionally AC that has been modified by the deposition of or doping with one or more metals. And in particularly favorable embodiments, the catalyst comprises alumina that has been modified by doping with one or more metals, where the one or more metals are selected from the group consisting of period 4, period 5, and period 6 transition metals in groups IB, IIB, IIIB, IVB, VB, VIB, VIIB, and VIII. Exemplary metals M for producing metal-doped AC (AC/M) and metal-doped alumina (Alumina/M) include nickel (Ni) and molybdenum (Mo), which are preferred over other viable alternatives such as palladium (Pd) and platinum (Pt) due to the higher cost of the noble metals. In particularly favorable embodiments Alumina/M is further modified with the deposition of a lanthanide-series metal L, e.g., cerium (Ce), to obtain a lanthanide-doped Alumina/M (Alumina/M/L). In other embodiments, the catalyst may be zeolites or zeolite substrates modified by the deposition of transition metals and/or lanthanides.

In particular embodiments, the reactor is configured with a first section (S1) and a second section (S2) to promote, respectively, D1-D3 and D4-D6 substantially sequentially. That is, D1-D3 occur predominantly in S1 while D4-D6 occur predominantly in S2. The two stages are differentiated principally on the basis of the stationary phase contained in each and the temperature ranges within which each is operated. The stationary phases may be the same or different, or in some embodiments S1 or a subsection thereof may contain none. The temperatures at which the sections are operated are different, S1 being operated in a range that is below that of S2 such that the maximum temperature in S1 is the about the same or lower than the minimum temperature in S2. The reactor may be a single, physically continuous tube or two separate tubes that are communicably coupled such that S2 is downstream from S1. In both cases, the reactor is configured to separately control the temperature range at which each section operates. In other particular embodiments the first section comprises subsections, each of which may be filled with the same stationary phase, or optionally, with stationary phases that are different. And in yet other embodiments, the first subsection of the first section contains no stationary phase.

In particular embodiments the temperature of the first section is controlled to a range TRange1, which is within a first temperature range TRange/S1 of about 260° C. to about 365° C.; the temperature of the second section is controlled to a range TRange2, which is within a second temperature range TRange/S2 of about 320° C. to about 420° C.; TRange1 spans a temperature range equal to the difference between the highest and the lowest temperatures applied in the range TRange/S1, and TRange2 spans a temperature range equal to the difference between the highest and the lowest temperatures applied in TRange/S2; and the heating of each section is accomplished in a fashion such that the temperature in a downstream portion of a section is generally higher than in an upstream portion, e.g., the temperature increases substantially progressively within each section as the process fluid flows downstream from the reactor inlet through the reactor. In particular embodiments, the magnitudes of TRange1 and TRange2 are about the same while in other embodiments one can be between about 2 to about 20 times greater than the other, each being selected to maximize the yield of Desirable Reactions promoted in the respective sections while minimizing Undesirable Reactions.

In particular embodiments, the net magnitudes of TRange1 and TRange2, e.g. the difference between the maximum and minimum temperature in each, may be the same or different and each may have a value that is less than about 75° C., less than about 50° C., less than about 25° C., or less than about 10° C., while in yet other particular embodiments the temperature in S1 and/or S2 is substantially isothermal, e.g. the net magnitudes of TRange1 and/or TRange2 are less than about 5° C.; and TRange1 and TRange2 each lies in their respective ranges TRange/S1 and TRange/S2 such that the maximum temperature of TRange1 and the minimum of TRange2 differ by less than about 75° C., less than about 50° C., less than about 25° C., less than about 10° C., or less than about 5° C.

TABLE VI

DEFINITION OF TRange/S1 AND TRange/S2 AND EXAMPLES OF OPERATING RANGES TRange1 AND TRange2 WITHIN THEM.

| | TRange/S1 | TRange/S2 |
|---|---|---|
| Minimum T, ° C. | About 260 | About 320 |
| Maximum T, ° C. | About 365 | About 420 |
| Net Ranges* for TRange1 and TRange2, ° C. | ≤75, ≤50, ≤25, ≤10, ≤5 | ≤75, ≤50, ≤25, ≤10, ≤5 |
| Examples | TRange1 | TRange2 |
| | 280-330 | 360-410 |
| | 300-340 | 360-380 |
| | 325-350 | 373 ± 2 |
| | 350-360 | 360-390 |
| | 345-349 | 360-375 |
| | 344 ± 2 | 375-385 |

*Net ranges for TRange1 and TRange2 may be the same or different

In particular embodiments, the reactor is configured to control the pressure in S1 and S2 independently. The pressure in S1, including any constituent subsections, is controlled at a level sufficient to substantially maintain water in the process fluid in the liquid phase, e.g., at greater than about 580 psi when the maximum temperature in S1, Tmax (S1), is about 250° C.; at greater than about 870 psi when Tmax(S1) is about 275° C.; at greater than about 1250 psi when Tmax(S1) is about 300° C.; at greater than about 1750 psi when Tmax(S1) is about 325° C.; greater than about 2400 psi when Tmax(S1) is about 350° C.; while in preferable embodiments the pressure in S1 is greater than about 2710 psi when Tmax(S1) is about 360° C.; and in highly preferable embodiments the pressure is greater than about 2875 psi when Tmax(S1) is about 365° C. Not wishing to be limited by any particular theory of operation, such conditions are advantageous due to the possibility for aqueous phase reforming (APR) which presumably favors D2 on kinetic grounds due to the high concentration of water in the liquid phase compared with vapor phase at lower pressures. Yet, the inventors have determined that rates of desirable reaction in S1 also are appreciable at even at pressures somewhat lower where water exists as a vapor. For example, in particular embodiments the temperature is between about 330° C. and about 365° C. and pressure is about 1800 psi. In preferred embodiments the pressure at the outlet from Section 2 is controlled to a pressure of less than or equal to that at the outlet of S1 and in highly preferred embodiments to less than about 500 psi.

While D1 is known to occur readily in S1 even at relatively low temperatures, the inventors obtained evidence indicating that in embodiments of the instant invention, rates for D2 and D3 promoted in S1 are significantly higher than for any of U1-U5, e.g., when temperatures are in the range of about 350° C. to about 365° C. and pressure is maintained at about 1800 psi where water exists in the vapor phase or at higher pressures where water is in the liquid phase. That is, D1-D3 are highly favored in S1, occurring substantially quantitatively while the opposite holds for U1-U5. This is expected for U1, U3, and U5, but were it not also the case for U2 and U5, consumption of fatty acids by polymerization and/or reforming would be problematic. The conclusion, which represents an important key to the instant invention, is that molecules such as glycerol, which contain oxygen in hydroxyl rather than carbonyl functional groups, readily undergo reaction D2c whereas fatty acids do not.

In other particular embodiments, the reactor is configured to maintain pressures in S1 and S2 at pressures of less than about 2500 psi such that the process fluid remains in the liquid phase in S1 or in at least one upstream subsection of S1 while water in S2 may be in the vapor phase, or optionally in the liquid phase in an upstream portion of S2 prior to converting to a vapor in a downstream portion of S2, in accordance with the prevailing temperature(s).

In other particular embodiments, the pressure within the entire reactor is determined substantially by controlling the pressure at the outlet from S2, e.g., the pressure in S1 is not controlled separately from that of S2. In such embodiments, the process fluid in substantially all of S1 is maintained in the liquid phase when the pressure at the reactor outlet is maintained at about 1750-1760 psi when Tmax(S1) is about 325° C., or at about 2400-2500 psi when Tmax(S1) is about 350° C. At those pressures, when the minimum temperature of TRange2 is greater than about 350° C., then water in the process fluid flowing from S1 into S2 will vaporize.

Descriptions given of various embodiments with respect to temperature and pressure do not preclude the possibility that the localized temperature of the process fluid itself may have a temperature that is lower at the inlet to S2, or to a subsection thereof, than it has before leaving S1. For example, those skilled in the art will recognize the possibility that at a point in S2 where the pressure is reduced such that water and/or other components vaporize, adiabatic cooling of the process fluid may occur, causing its temperature to fall. But S2 is purposefully configured to overcome this effect and further heat the process fluid to temperatures sufficient to promote decarboxylation.

In yet other particular embodiments the first section comprises two subsections, e.g., Section 1 Subsection 1 (S1.1) and Section 1 Subsection 2 (S1.2), which are communicably coupled with each other and with the second section (S2) such that S1.1 is upstream from S1.2 and S1.2 is upstream from S2. S1.1 is configured to favorably promote at least D1 of the plurality of First Desirable Reactions D1-D3. It may contain a stationary phase consisting of alloy particles, e.g. ball bearings made of stainless steel or other nickel-containing alloys such as Hastelloy-C; or optionally, it may contain no stationary phase. Though wishing to not be bound by any particular theory of operation, D1 is known to proceed quantitatively without catalyst at temperatures in TRange/S1 while D2 D3 are known by the inventors to also proceed favorably under the same conditions, albeit less readily than D1. Accordingly, in particularly favorable embodiments, S1.2 is configured with a stationary phase selected to further facilitate D2 D3 such that each progresses to an extent that is greater than about 90%, greater than about 95%, and even greater than about 98% to obtain fatty acids from oil in the process fluid that are substantially saturated, where the stationary phase may be, by way of nonlimiting example, AC/M, Alumina/M, or Alumina/M/L.

In other particular embodiments, an optional material injected at one or more points downstream from S1 is a portion of the hydrocarbon product, which substantially comprises saturated alkanes. Not wishing to be bound by any particular theory of operation, water may function in S2 as a mobile phase that serves as a vehicle to carry fatty acids and their deoxygenated products downstream through the stationary phase. In the thought that the hydrocarbon product can serve a similar function insofar as it exists in vapor phase in S2, injecting some saturated diesel product into S2 may permit reduction in the oil-water ratio so as to likewise reduce the entropic penalty discussed previously. Optionally, this same result may be achieved by using an unreactive gas such as nitrogen or carbon dioxide instead of the hydrocarbon product. And in yet other particular embodiments, small amounts of hydrogen gas ($H_2$) may be injected at the inlet to S2 for the purpose of helping maintain catalyst activity. In the limit, the aforementioned penalty may be minimized or substantially eliminated by the interposition of a liquid-liquid separator between S1 and S2 for the purpose of removing water from the process fluid to obtain a feed for S2 that substantially comprises saturated fatty acids. In such an embodiment, S2 would be configured to augment the feed with amounts of water and glycerol (or a suitable alternative) to generate additional quantities of [H] by D2 sufficient to enable D4-D6.

In certain cases, removal of residual fatty acids from the hydrocarbon product may be desirable. Particular embodiments of the current invention provide for the separation of water from the hydrocarbon product and the subsequent passing of the latter through a stationary phase configured to preferentially retain the fatty acids (FA), where a stationary phase may consist of, by way of nonlimiting example, alumina, zeolites, or aluminosilicates. At the point where the capacity of the stationary phase to retain FA has been exhausted, an alcohol such as methanol or ethanol may be used to simultaneously desorb and esterify the fatty acids to produce a fatty acid ester that may be blended with the hydrocarbon product. Alternatively, the FA accumulated on the stationary phase may be desorbed with alcohol and recycled to reactor inlet. In yet other embodiments, the deoxygenated hydrocarbons may be distilled from the product mixture and the higher-boiling FA recycled to the reactor inlet.

In particularly favorable embodiments, oil:water is about 1:1 to about 1:3; S1 operates at TRange1 between about 330° C. and about 365° C. with pressure at the S1 outlet controlled to a level greater than about 1800 psi; and S2 operates at TRange2 between about 365° C. and about 390° C. and a pressure at the S2 outlet of less than about 1000 psi.

On the basis of the foregoing enumeration of embodiments of the instant invention, one skilled in the art will recognize the possibility to configure and apply a single-stage reactor to preferentially effect, first D1-D3 and then D4-D6. In such an approach, a quantity of oil is processed through a reactor configured to quantitatively hydrolyze any glyceryl esters by D1; produce hydrogen equivalents [H] by the reforming of glycerol according to D2; substantially reduce native unsaturations in fatty acids by D3; and then separate fatty acids from water in the product stream and accumulate the former in a suitable vessel, which is the first product. The aforementioned configuration includes a reactor, or one or more subsections thereof, filled with a stationary phase suitable to promote D2 and especially D3, and the operation thereof within at temperature range TRange1, which is within a range TRange/S1. Subsequently, the selfsame reactor is conditioned to operate within a temperature range TRange2, which is within a range TRange/S2, and the first product combined with water is fed thereinto so as to effect D4-D6 to obtain the second product, which substantially comprises saturated alkanes of diesel quality. In chemical engineering parlance, the two steps are processing campaigns, the first campaign producing material that is feed for the second.

In yet another particular embodiment, the reactor comprises only S1 as described in various embodiments hereinabove. Such embodiments substantially effect D1-D3 for the purpose of producing saturated fatty acids (FA) in high yield from renewable oils, where saturated FA have value as ingredients in diverse industrial and consumer products. In particularly favorable embodiments oil:water is about 1:1 to about 1:3, S1 operates at a temperature of about 330° C. to about 365° C., and pressure at the S1 outlet is controlled at a level greater than about 1800 psi.

The preceding description of embodiments establish the instant invention and embodiments thereof as means for producing HTRD by configuring and controlling a reactor in a manner not anticipated in prior art, namely, to advantageously (i) promote a plurality of desirable chemical reactions that include substantially saturating and deoxygenating the renewable oil, and (ii) substantially minimizing undesirable reactions that reduce the yield of the hydrocarbon product. Those skilled in the art will appreciate those embodiments to be illustrative and nonlimiting examples of other embodiments for accomplishing those two outcomes by application of principles and concepts detailed hereinabove.

FIGURES

FIGS. 1-1F and 2-2D present exemplary approaches for configuring systems and methods to producing HTRD by Low-P TCD in accordance with the Detailed Description above and the various embodiments enumerated therein. In each, the header provides relevant information about the stationary phase, temperature, pressure, phase (of the process fluid), and the water-oil ratio (water:oil). To the extent possible, the temperature regimes are defined in terms consistent with terminology used in the Detailed Description. Because the Figures are largely self-explanatory, are accompanied by detailed descriptions, and their correspondence with embodiments in the Detailed Description self-evident, additional descriptions and discussion of the figures will not be offered presently. Yet, the elaboration on FIG. 1A in the following Description of Figures with Discussion serves to elucidate concepts important to the appreciation of FIGS. 1B-1F and 2A-2D.

DISCUSSION OF FIGURES

The significance of Table I is not only that it inventories reactions that transform oil to product in Low-P TCD, but that it also portrays how the reactions may occur substantially progressively in consideration of thermodynamic factors. For example, those skilled the art will recognize the possibility to readily achieve D1 under relatively mild conditions, e.g. at temperatures below about 350° C., and even below about 300° C., without invoking heterogeneous catalysts or homogeneous catalysis by means of Lowry-Brønsted acids or bases. The inventors of the instant system and method for upgrading oils recognized that D2 and D3 may occur subsequently at temperatures above about 325° C. Overall, D1-D3 were found to occur more readily, at lower temperature with or without catalyst, compared with D4-D6. More to the point, (i) rates for D1-D3 were found to be high when the process fluid is substantially maintained in the liquid phase (wherein the concentration of water is high) at high pressure and temperatures below about 360° C.; while (ii) those conditions are not at all conducive to D4-D6, which instead are favored when temperatures exceed about 360° C. and pressure is relatively low. In general, the kinetic and/or thermodynamic favorability of D1-D6 substantially decreases in that order, a fact borne out by experimental results. With that insight, the present inventors determined that D1-D6 also can occur progressively terms of the reaction coordinate in a flow-through reactor, which runs the length of the reactor from the primary inlet to the outlet.

FIG. 1A portrays this at three levels. At the top is a depiction of a particular embodiment of the reactor containing a stationary phase, which is divided into two sections ordered along the downstream flowpath of the reactor. Although the sections are not necessarily discrete in the sense of physical demarcation, neither are they merely conceptual. To understand that, consider the plot immediately below the reactor. It shows the extent of reaction along the reaction coordinate for each of D1-D6, where the value 1 signifies the reaction is quantitatively complete. Not wishing to be bound by a particular theory of operation, FIG. 1A supports several important observations. First, and as already discussed in connection with Table I, the reactions are successive in the sense that kinetic and/or thermodynamic favorability (the "ease") of each reaction in the series is lower than that of the previous and therefore begins to occur to any significant extent after the previous. Thus, D1 is well advanced before D2 gets underway. Similarly, when the extent of reaction for D3 is barely appreciable, that for D2 is quite significant.

Second, in each section, certain reactions are concurrent. That is, multiple reactions may be occurring simultaneously at any given point along the reaction coordinate. Third, the decreasing slopes in the progression from D1 to D6 further depicts the decreasing reaction rates due to the aforementioned decrease in ease of reaction.

Additional clarification should be made regarding the portrayal of D5 in FIG. 1A. Given that the reduction is ostensibly the same as that for D3, it could be argued that because it occurs faster than D4, the latter is rate-limiting and slope for D5 and therefore should coincide with it. Indeed, that would be true if all things were equal, or if D5 only involved the same reactions as D3. However, to the extent that hydrodeoxygenation occurs, it is expected to be much slower than D3. Also, in some instances the oil may not consist substantially of pure, simple triglycerides, but instead may contain compounds with other unsaturated structures that undergo reduction less readily. And finally, the quantities of hydrogen equivalents [H] that are available in S1 are higher than in S2 for the simple reason that a significant fraction has been consumed in D3. The lower concentration of [H] in S2 therefore can be expected to diminish the rates of reduction in D5.

Though again wishing to not to be bound by any particular theory of operation, the inventors offer FIG. 1A as a non-limiting, general, and qualitative depiction of process outcomes thought to have a basis in the chemistries presented in Table I. The intent of the associated discussion and explanations is not to present a complete account of all chemical realities involved with the conversion of oil to product, nor should the lack of such a complete accounting be interpreted as implying that no other chemistry occurs in connection with the chemistry described. Indeed, those skilled in the art recognize that each reaction in Table I presents net reactions that may encompass numerous other reactions occurring by way of numerous chemical intermediates not shown in Table I. The aim, then, is to (i) indicate the principal chemistries that can account generally for the process outcome, which is the transformation of oil into hydrocarbons that are substantially saturated and deoxygenated; and (ii) support the explanation of how the instant invention promotes those chemistries by means that are novel, unique, and non-obvious.

The present invention has been described in particular detail with respect to various possible embodiments, and those of skill in the art will appreciate that the invention may be practiced in other embodiments. First, the particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead performed by a single component.

Some portions of above description present the features of the present invention in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by real time network operating systems.

Embodiments of the present invention also relate to an apparatus for performing the operations herein. This apparatus may be specially constructed for the required purposes, or it may comprise a computer selectively activated or reconfigured by a computer program stored on a computer readable medium that can be accessed by the computer. Such a computer program may be stored in a tangible, non-transitory, computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), any other appropriate static, dynamic, or volatile memory or data storage devices, or other type of media suitable for storing electronic instructions, and each coupled to a computer system bus. Furthermore, the computers referred to in the specification may include a single processor or may be architectures employing multiple processor designs for increased computing capability.

Various systems may also be used with programs in accordance with the teachings herein, or it may prove convenient to construct more specialized apparatus to perform the required method steps. The required structure for a variety of these systems will be apparent to those of skill in the art, along with equivalent variations. In addition, the present invention is not described with reference to any particular programming language. It is appreciated that a variety of programming languages may be used to implement the teachings of the present invention as described herein, and any references to specific languages are provided for disclosure of enablement and best mode of the present invention.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims. It should be further understood that any of the features described with respect to one of the embodiments described herein may be similarly applied to any of the other embodiments described herein without departing from the scope of the present invention.

The invention claimed is:

1. A system configured for converting renewable oil into a hydrocarbon product in high yield by a plurality of desirable chemical Reactions D1-D6 which hydrolyze glyceryl esters present in the oil, substantially reduce unsaturations in the resulting free fatty acids, and deoxygenate the fatty acids while substantially minimizing undesirable Reactions U1-U5 that reduce the yield, the system comprising:

(a) a flow path configured to continuously convey a process fluid into and in a downstream direction through a reactor, the process fluid including renewable oil and water;

(b) a primary inlet at an upstream portion of the reactor configured for introduction of the process fluid into the reactor;

(c) the reactor configured as a tube whose length is between about 8 and about 80 times its inside cross-sectional dimension, which tube comprises one or more sections or subsections that are communicably coupled in series to permit the process fluid to flow therethrough;

(d) a first section (S1) of the one or more sections or subsections configured to heat and to control the temperature of the flowing process fluid and any stationary phase therein, within a first temperature range TRange1, which is within the range TRange/S1 of between about 250° C. and about 400° C., where the stationary phase, if present, and the temperature range are selected to facilitate substantially sequential chemical reactions in a first subset of the plurality of desirable Reactions D1-D3;

(d) the system configured for conveying the process fluid into the reactor inlet at a rate between about 0.1 and about 25 expressed in terms of oil volume in units of V(r)/hour where V(r) is the volume of the reactor; and (f) an outlet disposed at a downstream portion of the reactor to withdraw the process fluid in the form of a mixture comprising the hydrocarbon product and water.

2. The system of claim 1, wherein the reactor is configured to receive one or more materials therein at the primary inlet and/or at one or more inlets to the reactor downstream from the primary inlet such that the one or more materials combine with the process fluid and flow with the process fluid in a downstream direction through the reactor, the one or more additional materials being selected to promote one or more of desirable reactions D1-D6.

3. The system of claim 2, further comprising:

one or more different materials disposed within at least one of the one or more sections or subsections, the one or more different materials configured to permit flow of the process fluid therethrough to facilitate the desirable chemical reactions, which materials also may be referred to as a fixed bed or as a stationary phase.

4. The system of claim 3, wherein a second section (S2) is communicably coupled to the first section (S1), second section (S2) being configured to receive output from first section (S1) and to heat and to control the temperature of the flowing process fluid and any stationary phase therein, within a second temperature range TRange2, which is within the range TRange/S2 of between about 325° C. to about 425° C., where the minimum temperature corresponding to TRange2 is about the same or higher than the maximum temperature corresponding to TRange1, and the stationary phase, if present, and the temperature range are selected to facilitate chemical reactions in a second subset of the plurality of desirable Reactions D4-D6.

5. The system of claim 4, wherein the first section (S1) is configured as two subsections, with the first subsection being controlled to a temperature range whose maximum temperature is lower than or equal to the minimum temperature of the second subsection such that certain reactions in the first subset of desirable reactions are favored in the first subsection while certain other reactions in the first subset of desirable reactions are favored in the second subsection.

6. The system of claim 5, wherein at least a portion of the first section (S1) is configured without a stationary phase.

7. A system configured for converting renewable oil into saturated fatty acids (SFA) by a plurality of desirable chemical Reactions D1-D3 which hydrolyze glyceryl esters present in the oil, and substantially reduce unsaturations in the resulting free fatty acids without causing undesirable Reactions U1-U5, the system comprising:

(a) a flow path configured to continuously convey a process fluid into and in a downstream direction through a reactor section (S1), the process fluid including renewable oil and water;

(b) a primary inlet at an upstream portion of (S1) configured for introduction of the process fluid into the reactor;

(c) (S1) configured as a tube whose length is between about 8 and about 80 times its inside cross-sectional dimension;

(d) (S1) configured to control the temperature of the flowing process fluid and any stationary phase therein, within a temperature range TRange1, which is within the range TRange/S1 of between about 250° C. and about 360° C., where the stationary phase, if present, and temperature range TRange1 are selected to facilitate the plurality of desirable Reactions D1-D3;

(e) the system configured to convey the process fluid into the inlet to (S1) at a rate between about 0.1 and about 25 expressed in terms of oil volume in units of V(r)/hour where V(r) is the volume of the reactor; and (f) an outlet disposed at a downstream portion of (S1) to withdraw the process fluid in the form of a mixture comprising (SFA) and water.

8. The system of claim 7, wherein the renewable oil comprises (FAGE) including (TAG).

9. The system of claim 7, configured to substantially reduce unsaturations in the resulting free fatty acids without causing subsequent deoxygenation.

10. The system of claim 7, for converting renewable oil into a hydrocarbon product in high yield by a plurality of desirable chemical Reactions D1-D6 which hydrolyze glyceryl esters present in the oil, substantially reduce unsaturations in the resulting free fatty acids, and deoxygenate the fatty acids while substantially minimizing undesirable Reactions U1-U5 that reduce the yield, the system further comprising:

the temperature range TRange1 of the reactor section (S1) being in the range TRange/S1 that is from about 250° C. to about 400° C.;

communicably coupling reactor section (S1) with a second section (S2) to receive the output from (S1) and to heat and to control the temperature of the flowing process fluid and any stationary phase therein within a second temperature range TRange2 being in the range TRange/S2 that is from about 325° C. to about 425° C., where a minimum temperature of TRange2 is about the same or higher than a maximum temperature of TRange1, and the stationary phase, if present, and the temperature range TRange2 are selected to facilitate chemical reactions in a second subset of the plurality of desirable Reactions D4 D6;

an optional configuration of (S1) as at least two subsections, with the first subsection being controlled to a temperature range whose maximum temperature is lower than or equal to the minimum temperature of the second subsection such that certain reactions in the first subset of desirable reactions are favored in the first subsection while certain others are favored in the second subsection; and an optional configuration of (S1) or a subsection thereof with no stationary phase; and the withdrawing from an outlet disposed at a downstream portion of (S2) of the process fluid in the form of a mixture comprising the hydrocarbon product and water.

11. The system of claim 7, wherein the renewable oil is derived from non-fossil-fuel sources selected from the group consisting of animals, plants, vegetables, fruits, grains, seeds, algae, plankton, and the like, and includes one or more materials taken from the group including but not limited to corn distillers oil (CDO); fatty acid glyceryl esters (FAGE) including mono-, di-, and tri-acylglycerols (TAG); and free fatty acids (FFA).

12. The system of claim 11, wherein a water-oil ratio is between about 1:5 and about 5:1, where the amount of water is that in excess of the quantity consumed in favorable reactions involved with upgrading.

13. The system of claim 12, wherein when an amount of glycerol native to the oil is determined to be insufficient to meet stoichiometric demand in various upgrading reactions for hydrogen equivalents (Reactions D3, D5, and D6) generated through the reforming of glycerol (Reaction D2), an additional material including glycerol or a solution of glycerol in water is introduced to the reactor inlet and/or at one or more points to the reactor downstream from the reactor inlet, wherein the amount of glycerol injected is sufficient to meet the demand for [H] and the amount of water in the reactor is sufficient to not be stoichiometrically limiting with respect to hydrolysis or reforming reactions, e.g., Reactions D1 and D2.

14. The system of claim 13, wherein the added glycerol provides a quantity of [H] that exceeds the stoichiometric demand in upgrading reactions by between about 0.5% and about 25%.

15. The system of claim 7, wherein an additional material introduced at the reactor inlet and/or at one or more points in the reactor downstream from the inlet (i) serves as a source of hydrogen equivalents [H] upon undergoing reforming according to a Reaction D2c; and (ii) comprises one or more oxygenated compounds, or a solution of the same in water, each of which includes Carbon, Hydrogen, and Oxygen atoms to have the general formula $C_uH_vO_w$, selected from the group consisting of polyols, glycerol, ethylene glycol, propylene glycol, propane diol, butane diol, butane triol, glycerol, pentaerthritol, polyethylene glycol ethers, alcohols, methanol, ethanol, propanol, sugars, carbohydrates, oxygen-containing organic compounds in biomass-derived components obtained by pyrolysis of cellulose, hemicellulose, and lignin, organic acids, esters, alcohols, aldehydes, ketones, furans, phenols, dehydrated carbohydrates, and mixtures and combinations thereof.

16. The system of claim 10, wherein an additional material injected into (S2) is oil in an amount sufficient to provide a quantity of hydrogen equivalents [H] in accordance with Reaction (D2c') to support the thermocatalytic decarboxylation of fatty acids, the oil being one or more selected from the group consisting of: saturated and unsaturated fatty acids; (FAGE) containing saturated and unsaturated fatty acids; or (FAGE) containing saturated and unsaturated fatty acids that have been hydrolyzed to obtain glycerol and (FFA).

17. The system of claim 7, wherein the stationary phase includes one or more catalysts suitable for certain desirable reactions including but not limited to (i) the reforming of oxygenated compounds $C_uH_vO_w$ to produce hydrogen equivalents [H] according to Reaction D2c; (ii) the reduction of unsaturations native to fatty acids in the oil according to Reaction D3; (iii) the deoxygenation of the carboxylate group in fatty acids in the oil according to Reaction D4; and (iv) reduction of any terminal unsaturations formed by decarbonylation of fatty acids in the oil according to Reaction D5.

18. The system of claim 17, wherein the catalyst includes activated carbon (AC) or optionally (AC) that has been modified by the deposition of or doping with one or more metals, or the catalyst comprises alumina that has been modified by doping with one or more metals, where the one or more metals (M) are selected from the group consisting of period 4, period 5, and period 6 transition metals in groups IB, IIB, IIIB, IVB, VB, VIB, VIIB, and VIII.

19. The system of claim 18, wherein metals (M) for producing metal-doped AC (AC/M) and metal-doped alumina (Alumina/M) are, respectively nickel (Ni); and molybdenum (Mo), palladium (Pd), platinum (Pt).

20. The system of claim 10, wherein subsets of the desirable Reactions D1-D3 and D4-D6, respectively occur substantially sequentially in section (S1) and section (S2).

21. The system of claim 20, wherein magnitudes of TRange1 and TRange2 range from being about the same to about 20 times greater than the other, each being selected to maximize yield of the subset of desirable reactions occurring in the corresponding section while minimizing the undesirable reactions.

22. The system of claim 21, configured to control pressure in (S1) and (S2) independently, each at a level sufficient to maintain water in the process fluid in the liquid phase, at greater than about 580 psi when the maximum temperature in) (S1), Tmax(S1), is about 250° C., and at greater than about 870 psi when Tmax(S1) is about 275° C., and at greater than about 1250 psi when Tmax(S1) is about 300° C., and at greater than about 1750 psi when Tmax(S1) is about 325° C., and between about 2400 psi and about 2500 psi when Tmax(S1) is about 350° C., with pressure at an outlet from (S2) being controlled to a pressure of less than about 2500 psi.

23. The system of claim 21, configured to control pressure in (S1) and (S2) independently to maintain pressures of less than about 2500 psi such that the process fluid remains in the liquid phase in (S1) or in at least one upstream subsection of (S1) while water in (S2) may be in the vapor phase, or optionally in the liquid phase in an upstream portion of (S2) prior to converting to a vapor in a downstream portion of (S2).

24. The system of claim 21, wherein pressure within the reactor is determined by controlling the pressure at the outlet from (S2), when the pressure in (S1) is not controlled separately from that of SAS 2 wherein the process fluid in substantially all of (S1) is maintained in the liquid phase when the pressure at the reactor outlet is maintained at about 1750-1760 psi when Tmax(S1) is about 325° C., or at about 2400-2500 psi when Tmax(S1) is about 350° C., wherein at those pressures, when the minimum temperature of TRange2 is greater than about 350° C., then water in the process fluid flowing from (S1) into (S2) will vaporize.

25. The system of claim 10, wherein section (S1) comprises two subsections (S1.1) and (S1.2), which are communicably coupled with each other and with the second section (S2) such that (S1.1) is upstream from (S1.2) and (S1.2) is upstream from (S2), with (S1.1) being configured to favorably promote at least Reaction D1 of the first subset of desirable Reactions D1-D3, and optionally contains a stationary phase including alloy particles of stainless steel or other nickel-containing alloys; (S1.2) includes a stationary phase selected to further facilitate Reactions D2 D3 such that each progresses to an extent that is greater than about 90% to obtain fatty acids from oil in the process fluid that are substantially saturated.

26. The system of claim 25, wherein a material injected at one or more points downstream from (S1) is selected from the group consisting of a portion of a hydrocarbon product, a saturated alkane, an unreactive gas, nitrogen, hydrogen gas ($H_2$), and mixtures or combinations thereof.

27. The system of claim 10, configured to remove residual fatty acids from the hydrocarbon product, wherein water is separated from the hydrocarbon product prior to passing the hydrocarbon product through a stationary phase configured to preferentially retain the fatty acids (FA), wherein the stationary phase includes alumina, zeolites, or aluminosilicates.

28. The system of claim 27, wherein at a point at which capacity of the stationary phase to retain (FA) has been exhausted, an alcohol is used to simultaneously desorb and esterify the fatty acids to produce a fatty acid ester that is then blended with the hydrocarbon product, and/or the desorbed (FA) accumulated on the stationary phase may be desorbed with alcohol and recycled to reactor inlet, and/or the deoxygenated hydrocarbons may be distilled from the product mixture and the higher-boiling (FA) recycled to the reactor inlet.

29. The system of claim 7, wherein (S1) is configured to receive one or more materials therein at the primary inlet and/or at one or more inlets to (S1) downstream from the primary inlet such that they combine with the process fluid and flow with it in a downstream fashion through the reactor, the one or more additional materials being selected to promote one or more of desirable reactions D1-D6.

30. The system of claim 29, wherein (S1) comprises a plurality of subsections that are communicably coupled in series to permit the process fluid to flow therethrough.

31. The system of 29, further comprising one or more different materials disposed within at least a portion of (S1), the one or more different materials configured to permit flow of the process fluid therethrough to facilitate the desirable chemical reactions, which materials also may be referred to as a fixed bed or as a stationary phase.

32. The system of claim 9, configured to substantially reduce unsaturations in the resulting free fatty acids without causing subsequent decarboxylation by Reaction D4, and/or undesirable Reaction U5.

33. The system of claim 12, wherein the water-oil ratio is between about 1:4 and 4:1, and still more particularly, between about 1:3 and 3:1.

34. The system of claim 33, wherein the water-oil ratio is between about 1:3 and 3:1.

35. The system of claim 14, wherein the added glycerol provides a quantity of [H] that exceeds the stoichiometric demand in upgrading reactions by between about 0.5% and about 15%.

36. The system of claim 35, wherein the added glycerol provides a quantity of [H] that exceeds the stoichiometric demand in upgrading reactions by between about 0.5% and about 5%.

37. The system of claim 22, wherein pressure at the outlet from (S2) is controlled to a pressure of less than about 1000 psi.

38. The system of claim 37, wherein pressure at the outlet from (S2) is controlled to a pressure of less than about 500 psi.

39. The system of claim 25, wherein (S1.2) includes a stationary phase selected to further facilitate Reactions D2 D3 such that each progresses to an extent that is greater than about 95%, and wherein the stationary phase includes AC/M, (Alumina/M), and/or (Alumina/M/L).

40. The system of claim 39, wherein (S1.2) includes a stationary phase selected to further facilitate Reactions D2 D3 such that each progresses to an extent that is greater than about 98%, and wherein the stationary phase includes AC/M, (Alumina/M), and/or (Alumina/M/L).

* * * * *